US007781979B2

(12) United States Patent
Lys

(10) Patent No.: US 7,781,979 B2
(45) Date of Patent: Aug. 24, 2010

(54) METHODS AND APPARATUS FOR CONTROLLING SERIES-CONNECTED LEDS

(75) Inventor: Ihor A. Lys, Milton, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 466 days.

(21) Appl. No.: 11/938,051

(22) Filed: Nov. 9, 2007

(65) Prior Publication Data

US 2008/0122376 A1 May 29, 2008

Related U.S. Application Data

(60) Provisional application No. 60/865,353, filed on Nov. 10, 2006, provisional application No. 60/883,626, filed on Jan. 5, 2007, provisional application No. 60/956,309, filed on Aug. 16, 2007.

(51) Int. Cl.
*H05B 37/00* (2006.01)
*G09G 5/00* (2006.01)

(52) U.S. Cl. ..... 315/185 S; 315/291; 315/247; 315/307; 315/312; 345/211; 345/212; 345/82; 345/102

(58) Field of Classification Search ..... 315/185 S, 315/200 A, 291, 307–311, 247, 246, 312–324; 345/82, 102, 211–214, 204
See application file for complete search history.

(56) References Cited

U.S. PATENT DOCUMENTS

| | | | |
|---|---|---|---|
| 4,017,847 | A | 4/1977 | Burford et al. |
| 5,457,450 | A | 10/1995 | Deese et al. |
| 5,688,042 | A | 11/1997 | Madadi et al. |
| 6,016,038 | A | 1/2000 | Mueller et al. |
| 6,072,280 | A | 6/2000 | Allen |
| 6,150,771 | A | 11/2000 | Perry |
| 6,150,774 | A | 11/2000 | Mueller et al. |
| 6,153,980 | A | 11/2000 | Marshall et al. |
| 6,166,496 | A | 12/2000 | Lys et al. |
| 6,211,626 | B1 | 4/2001 | Lys et al. |
| 6,292,901 | B1 | 9/2001 | Lys et al. |

(Continued)

FOREIGN PATENT DOCUMENTS

| | | | |
|---|---|---|---|
| EP | 0991304 | A | 4/2000 |

(Continued)

*Primary Examiner*—Tuyet Vo
(74) *Attorney, Agent, or Firm*—Mark L. Beloborodov

(57) ABSTRACT

Methods and apparatus for controlling series-connected LEDs. Two or more LEDs are connected in series between a first node and a second node, wherein a series current flows between the nodes when an operating voltage is applied across the nodes. One or more controllable current paths are connected in parallel with at least a first LED for at least partially diverting the series current around at least the first LED. A controller monitors at least one parameter representative of the operating voltage, determines a maximum number of the series-connected LEDs that can be energized by the operating voltage, and controls the controllable current path (s) so as to increase an amount of the series current that is diverted around at least the first LED when the maximum number is less than a total number of all of the LEDs connected in series. In one example, the foregoing may be implemented as an integrated circuit package to provide a lighting apparatus suitable for automotive applications.

25 Claims, 11 Drawing Sheets

U.S. PATENT DOCUMENTS

| | | | |
|---|---|---|---|
| 6,340,868 | B1 | 1/2002 | Lys et al. |
| D457,667 | S | 5/2002 | Piepgras et al. |
| D457,669 | S | 5/2002 | Piepgras et al. |
| D457,974 | S | 5/2002 | Piepgras et al. |
| D458,395 | S | 6/2002 | Piepgras et al. |
| 6,431,719 | B1 | 8/2002 | Lau et al. |
| D463,610 | S | 9/2002 | Piepgras et al. |
| 6,459,919 | B1 | 10/2002 | Lys et al. |
| 6,461,019 | B1 | 10/2002 | Allen |
| D468,035 | S | 12/2002 | Piepgras et al. |
| 6,528,954 | B1 | 3/2003 | Lys et al. |
| 6,548,967 | B1 | 4/2003 | Dowling et al. |
| 6,570,505 | B1 | 5/2003 | Malenfant |
| 6,577,080 | B2 | 6/2003 | Lys et al. |
| 6,580,228 | B1 | 6/2003 | Chen et al. |
| 6,608,453 | B2 | 8/2003 | Morgan et al. |
| 6,621,235 | B2 | 9/2003 | Chang |
| 6,624,597 | B2 | 9/2003 | Dowling et al. |
| 6,636,003 | B2 | 10/2003 | Rahm et al. |
| 6,680,579 | B2 | 1/2004 | Allen et al. |
| 6,717,376 | B2 | 4/2004 | Lys et al. |
| 6,720,745 | B2 | 4/2004 | Mueller et al. |
| D491,678 | S | 6/2004 | Piepgras et al. |
| D492,042 | S | 6/2004 | Piepgras et al. |
| 6,774,584 | B2 | 8/2004 | Lys et al. |
| 6,777,891 | B2 | 8/2004 | Lys et al. |
| 6,781,329 | B2 | 8/2004 | Morgan et al. |
| 6,788,011 | B2 | 9/2004 | Mueller et al. |
| 6,801,003 | B2 | 10/2004 | Schanberger et al. |
| 6,806,659 | B1 | 10/2004 | Mueller et al. |
| 6,869,204 | B2 | 3/2005 | Piepgras et al. |
| 6,883,929 | B2 | 4/2005 | Dowling |
| 6,888,322 | B2 | 5/2005 | Dowling et al. |
| 6,897,624 | B2 | 5/2005 | Ducharme et al. |
| 6,936,978 | B2 | 8/2005 | Morgan et al. |
| 6,965,205 | B2 | 11/2005 | Piepgras et al. |
| 6,967,448 | B2 | 11/2005 | Morgan et al. |
| 6,969,954 | B2 | 11/2005 | Lys |
| 6,975,079 | B2 | 12/2005 | Lys et al. |
| D518,218 | S | 3/2006 | Roberge et al. |
| 7,014,336 | B1 | 3/2006 | Ducharme et al. |
| 7,031,920 | B2 | 4/2006 | Dowling et al. |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,064,498 | B2 | 6/2006 | Dowling et al. |
| 7,113,541 | B1 | 9/2006 | Lys et al. |
| 7,132,785 | B2 | 11/2006 | Ducharme |
| 7,132,804 | B2 | 11/2006 | Mueller et al. |
| 7,135,824 | B2 | 11/2006 | Lys et al. |
| 7,139,617 | B1 | 11/2006 | Mueller et al. |
| 7,161,311 | B2 | 1/2007 | Mueller et al. |
| 7,161,313 | B2 | 1/2007 | Piepgras et al. |
| 7,161,556 | B2 | 1/2007 | Mueller et al. |
| 7,178,941 | B2 | 2/2007 | Roberge et al. |
| 7,180,252 | B2 | 2/2007 | Mueller et al. |
| 7,186,003 | B2 | 3/2007 | Dowling et al. |
| 7,187,141 | B2 | 3/2007 | Mueller et al. |
| 7,202,613 | B2 | 4/2007 | Morgan et al. |
| 7,204,622 | B2 | 4/2007 | Dowling et al. |
| 7,220,015 | B2 | 5/2007 | Dowling |
| 7,221,104 | B2 | 5/2007 | Lys et al. |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,242,152 | B2 | 7/2007 | Dowling et al. |
| 7,248,239 | B2 | 7/2007 | Dowling et al. |
| D548,868 | S | 8/2007 | Roberge et al. |
| 7,253,566 | B2 | 8/2007 | Lys et al. |
| 7,255,457 | B2 | 8/2007 | Ducharme et al. |
| 7,256,554 | B2 | 8/2007 | Lys |
| 7,274,160 | B2 | 9/2007 | Mueller et al. |
| 7,300,192 | B2 | 11/2007 | Mueller et al. |
| 7,303,300 | B2 | 12/2007 | Dowling et al. |
| 7,308,296 | B2 | 12/2007 | Lys et al. |
| 7,309,965 | B2 | 12/2007 | Dowling et al. |
| D562,494 | S | 2/2008 | Piepgras et al. |
| 2002/0074559 | A1 | 6/2002 | Dowling et al. |
| 2002/0078221 | A1 | 6/2002 | Blackwell et al. |
| 2002/0130627 | A1 | 9/2002 | Dowling et al. |
| 2002/0152045 | A1 | 10/2002 | Dowling et al. |
| 2002/0176259 | A1 | 11/2002 | Ducharme |
| 2003/0057884 | A1 | 3/2003 | Dowling et al. |
| 2003/0057886 | A1 | 3/2003 | Lys et al. |
| 2003/0076281 | A1 | 4/2003 | Morgan et al. |
| 2003/0133292 | A1 | 7/2003 | Mueller et al. |
| 2004/0052076 | A1 | 3/2004 | Mueller et al. |
| 2004/0105261 | A1 | 6/2004 | Ducharme et al. |
| 2004/0116039 | A1 | 6/2004 | Mueller et al. |
| 2004/0135522 | A1 | 7/2004 | Berman et al. |
| 2004/0141321 | A1 | 7/2004 | Dowling et al. |
| 2004/0212993 | A1 | 10/2004 | Morgan et al. |
| 2005/0035728 | A1 | 2/2005 | Dowling et al. |
| 2005/0041161 | A1 | 2/2005 | Dowling et al. |
| 2005/0047134 | A1 | 3/2005 | Mueller et al. |
| 2005/0063194 | A1 | 3/2005 | Mueller et al. |
| 2005/0099824 | A1 | 5/2005 | Dowling et al. |
| 2005/0116665 | A1 | 6/2005 | Colby et al. |
| 2005/0116667 | A1 | 6/2005 | Mueller et al. |
| 2005/0151489 | A1 | 7/2005 | Lys et al. |
| 2005/0174473 | A1 | 8/2005 | Dowling et al. |
| 2005/0213352 | A1 | 9/2005 | Lys et al. |
| 2005/0213353 | A1 | 9/2005 | Lys |
| 2005/0218870 | A1 | 10/2005 | Lys |
| 2005/0219872 | A1 | 10/2005 | Lys |
| 2005/0236998 | A1 | 10/2005 | Mueller |
| 2005/0248299 | A1 | 11/2005 | Chemel et al. |
| 2005/0253533 | A1 | 11/2005 | Lys et al. |
| 2005/0275626 | A1 | 12/2005 | Mueller |
| 2005/0276053 | A1 | 12/2005 | Nortrup |
| 2006/0002110 | A1 | 1/2006 | Dowling |
| 2006/0012987 | A9 | 1/2006 | Ducharme |
| 2006/0016960 | A1 | 1/2006 | Morgan |
| 2006/0022214 | A1 | 2/2006 | Morgan |
| 2006/0076908 | A1 | 4/2006 | Morgan |
| 2006/0098077 | A1 | 5/2006 | Dowling |
| 2006/0104058 | A1 | 5/2006 | Chemel et al. |
| 2006/0109219 | A1 | 5/2006 | Robinson et al. |
| 2006/0109649 | A1 | 5/2006 | Ducharme et al. |
| 2006/0132061 | A1 | 6/2006 | McCormick et al. |
| 2006/0152172 | A9 | 7/2006 | Mueller |
| 2006/0158881 | A1 | 7/2006 | Dowling |
| 2006/0170376 | A1 | 8/2006 | Dowling et al. |
| 2006/0198128 | A1 | 9/2006 | Piepgras et al. |
| 2006/0208667 | A1 | 9/2006 | Lys |
| 2006/0221606 | A1 | 10/2006 | Dowling |
| 2006/0244396 | A1 | 11/2006 | Bucur |
| 2006/0262521 | A1 | 11/2006 | Piepgras |
| 2006/0262544 | A1 | 11/2006 | Piepgras |
| 2006/0262545 | A1 | 11/2006 | Piepgras |
| 2006/0273741 | A1 | 12/2006 | Stalker, III |
| 2006/0285325 | A1 | 12/2006 | Ducharme et al. |
| 2007/0291483 | A1 | 3/2007 | Lys et al. |
| 2007/0086754 | A1 | 4/2007 | Lys et al. |
| 2007/0086912 | A1 | 4/2007 | Dowling |
| 2007/0115658 | A1 | 5/2007 | Mueller et al. |
| 2007/0115665 | A1 | 5/2007 | Mueller et al. |
| 2007/0145915 | A1 | 6/2007 | Roberge et al. |
| 2007/0152797 | A1 | 7/2007 | Chemel et al. |
| 2007/0153514 | A1 | 7/2007 | Dowling |
| 2007/0188114 | A1 | 8/2007 | Lys et al. |
| 2007/0188427 | A1 | 8/2007 | Lys et al. |
| 2007/0189026 | A1 | 8/2007 | Chemel et al. |

2007/0195526 A1 8/2007 Mueller et al.
2007/0206375 A1 9/2007 Piepgras et al.
2007/0236156 A1 10/2007 Lys et al.
2007/0237284 A1 10/2007 Lys et al.
2007/0258231 A1 11/2007 Koerner et al.
2007/0258240 A1 11/2007 Ducharme et al.
2007/0263379 A1 11/2007 Dowling et al.
2008/0012502 A1 1/2008 Lys
2008/0012506 A1 1/2008 Mueller et al.
2008/0191642 A1* 8/2008 Slot et al. ..... 315/295
2009/0160365 A1* 6/2009 Niemitalo ..... 315/294
2009/0284172 A1* 11/2009 Maschietto et al. ..... 315/294

FOREIGN PATENT DOCUMENTS

EP 1589519 A 10/2005
WO WO 98/21918 A 5/1998

* cited by examiner

METHODS AND APPARATUS FOR CONTROLLING SERIES-CONNECTED LEDS

CROSS-REFERENCES TO RELATED APPLICATIONS

The present application claims the benefit, under 35 U.S.C. §119(e), of the following U.S. provisional applications, each of which is incorporated herein by reference:

Ser. No. 60/865,353, filed Nov. 10, 2006, entitled "Methods and Apparatus for Controlling Devices in a Networked Lighting System;"

Ser. No. 60/883,626, filed Jan. 5, 2007, entitled "Methods and Apparatus for Providing Resistive Lighting Units;" and Ser. No. 60/956,309, filed Aug. 16, 2007, entitled "Methods and Apparatus for Controlling Series-connected LEDs."

BACKGROUND

Light emitting diodes (LEDs) are semiconductor-based light sources often employed in low-power instrumentation and appliance applications for indication purposes. LEDs conventionally are available in a variety of colors (e.g., red, green, yellow, blue, white), based on the types of materials used in their fabrication. This color variety of LEDs recently has been exploited to create novel LED-based light sources having sufficient light output for new space-illumination applications. For example, as discussed in U.S. Pat. No. 6,016,038, multiple differently colored LEDs may be combined in a lighting fixture, wherein the intensity of the LEDs of each different color is independently varied to produce a number of different hues. In one example of such an apparatus, red, green, and blue LEDs are used in combination to produce literally hundreds of different hues from a single lighting fixture. Additionally, the relative intensities of the red, green, and blue LEDs may be computer controlled, thereby providing a programmable multi-color light source. Such LED-based light sources have been employed in a variety of lighting applications in which variable color lighting effects are desired.

For example, U.S. Pat. No. 6,777,891 (the "'891 patent"), incorporated herein by reference, contemplates arranging a plurality of LED-based lighting units as a computer-controllable "light string," wherein each lighting unit constitutes an individually-controllable "node" of the light string. Applications suitable for such light strings include decorative and entertainment-oriented lighting applications (e.g., Christmas tree lights, display lights, theme park lighting, video and other game arcade lighting, etc.). Via computer control, one or more such light strings provide a variety of complex temporal and color-changing lighting effects. In many implementations, lighting data is communicated to one or more nodes of a given light string in a serial manner, according to a variety of different data transmission and processing schemes, while power is provided in parallel to respective lighting units of the string (e.g., from a rectified high voltage source, in some instances with a substantial ripple voltage).

The operating voltage required by each lighting unit (as well as the string, due to the parallel power interconnection of lighting units) typically is related to the forward voltage of the LEDs in each lighting unit (e.g., from approximately 2 to 3.5 Volts depending on the type/color of LED), how many LEDs are employed for each "color channel" of the lighting unit and how they are interconnected, and how respective color channels are organized to receive power from a power source. For example, the operating voltage for a lighting unit having a parallel arrangement of respective color channels to receive power, each channel including one LED having a forward voltage on the order of 3 Volts and corresponding circuitry to provide current to the channel, may be on the order of 4 to 5 Volts, which is applied in parallel to all channels to accommodate the one LED and current circuitry in each channel. Accordingly, in many applications, some type of voltage conversion device is desirable in order to provide a generally lower operating voltage to one or more LED-based lighting units from more commonly available higher power supply voltages (e.g., 12 VDC, 15 VDC, 24 VDC, a rectified line voltage, etc.).

One impediment to widespread adoption of low-voltage LEDs and low-voltage LED-based lighting units as light sources in applications in which generally higher power supply voltages are readily available is the need to convert energy from one voltage to another, which, in many instances, results in conversion inefficiency and wasted energy. Furthermore, energy conversion typically involves power management components of a type and size that generally impede integration. Conventionally, LEDs are provided as single LED packages, or multiple LEDs connected in series or parallel in one package. Presently, LED packages including one or more LEDs integrated together with some type of power conversion circuitry are not available. One significant barrier to the integration of LEDs and power conversion circuitry relates to the type and size of power management components needed to convert energy to the relatively lower voltage levels typically required to drive LEDs.

For example, voltage conversion apparatus (e.g., DC-to-DC converters) typically utilize inductors as energy storage elements, which cannot be effectively integrated in silicon chips to form integrated circuits. Inductor size is also a serious barrier to integrated circuit implementations, both in terms of an individual inductor component as part of any integrated circuit, as well as more specifically in LED packages. Furthermore, inductors typically cannot be made to be both efficient and handle a relatively wide range of voltages, and inductive converters generally require significant capacitance to store energy during converter operation. Thus, conventional voltage conversion apparatus based on inductors have a fairly significant footprint when compared with a single or multiple LED packages, and do not readily lend themselves to integration with LED packages.

Capacitive voltage conversion systems present similar challenges. Capacitive systems cannot convert voltage directly, and instead create fixed fractional multiplied or divided voltages. The number of capacitors required is directly related to the product of the integers in the numerator and denominator of the fraction. Since each capacitor also generally requires multiple switches to connect it between the higher voltage power source and a relatively lower voltage load, the number of components increases dramatically as the numerator and denominator increase, with a corresponding decrease in efficiency. If efficiency is a salient requirement, these systems must have practical ratios with a unity numerator or denominator; hence, either the input or output are low voltage at higher current, which effectively decreases efficiency. Thus, efficiency inevitably needs to be compromised at any particular operating voltage to decrease complexity and make simpler fractions.

SUMMARY OF THE INVENTION

Applicant has recognized and appreciated that it is often useful to consider the connection of multiple lighting units or light sources (e.g. LEDs), as well as other types of loads, to receive operating power in series rather than in parallel. A series interconnection of multiple LEDs may permit the use of operating voltages that are significantly higher than typical LED forward voltages, and may also allow operation of multiple LEDs or LED-based lighting units without requiring a transformer between a source of power (e.g., wall power or line voltage such as 120 VAC or 240 VAC) and the loads (i.e., multiple series-connected loads may be operated "directly" from a line voltage).

Accordingly, various embodiments of the present invention generally relate to methods and apparatus for controlling LED-based light sources, in which respective elements of a multi-element light source, and/or multiple light sources themselves, are coupled in series to receive operating power. A series interconnection of such components generally enables an increase in the overall operating voltage of the system; for example, three LEDs or LED-based lighting units each having a nominal operating voltage of approximately 3 to 7.4 VDC may be connected in series and operated at voltages of 9 to 24 VDC. Of course, virtually any appropriate number of LEDs or LED-based lighting units may be similarly coupled in series depending at least in part on the nominal operating voltage of each LED or lighting unit, and the expected nominal supply voltage provided by an available source of power. For purposes of the following discussion, various concepts relating to series-connected LEDs are discussed; however, it should be appreciated that many if not all of the concepts discussed herein similarly may be applied to various groupings of LEDs (serial, parallel, and/or serial/parallel arrangements), as well as multiple LED-based lighting units, that are coupled in series to receive operating power.

In one exemplary embodiment, multiple LEDs are connected nominally in series between two nodes to which an operating voltage is applied, and one or more controllable current paths are connected in parallel with one or more of the series-connected LEDs. In various aspects, the controllable current path(s) may be implemented as one or more controllable switches to completely divert current around a given LED, or as controllable variable or fixed current sources configured to divert all or only a portion of the series current flowing between the two nodes around the given LED. In this manner, the brightness of a given LED may be controlled and, in the extreme, the LED may be completely turned off by diverting current completely around it. In another aspect, a controller is configured to control the one or more controllable current paths according to any one of a number of techniques; for example, a controller may operate one or more controllable current paths based on data received as lighting instructions, and/or one or more measured parameters related to the available operating voltage applied to the two nodes.

More specifically, in one embodiment, the ability to divert current partially or fully around one or more series-connected LEDs is employed in circumstances in which a nominal expected operating voltage, applied to the two nodes between which the series-connected devices are connected, falls below a minimum operating voltage necessary to energize all of the series-connected devices. For example, in automotive applications based on an electrical system including a conventional 12 Volt automobile battery, the available operating voltage for automobile accessories when an engine is running and the electrical system is charging typically is between 13.8 to 14.5 Volts; however, when the engine is not running, the available operating voltage can drop quickly to 12 to 12.8 Volts, or even lower (e.g., when high loads are present, and/or as the automobile battery discharges further). Thus, a lighting apparatus for automotive applications based on series-connected LEDs should take into consideration all of the possible circumstances that affect available operating voltage.

In view of the foregoing, one embodiment of the present invention is directed to a lighting apparatus including multiple series-connected LEDs, one or more controllable current paths connected in parallel with one or more of the series-connected LEDs, and a controller to control one or more of the controllable current paths based on one or more monitored parameters representative of an available operating voltage for the series-connected LEDs. It should be appreciated that while an example of an automotive application was provided above, various implementations of this embodiment are not necessarily limited to automotive applications nor the particular range of contemplated operating voltages for such applications. More generally, in one aspect of this embodiment, the controller may be configured to control one or more of the controllable current paths so as to increase an amount of current that is diverted around a corresponding LED when one or more parameters indicate that the operating voltage is less than that required to energize all of the series-connected LEDs, so as to accordingly reduce the required operating voltage necessary to energize the series-connected devices. For example, in one implementation, the controllable current paths may be switches that completely divert current around a corresponding LED so as to essentially short out the LED and remove it from the series connection of devices. In this manner, the operating voltage necessary to operate the remaining series-connected LEDs is lowered by the individual operating voltage of each LED that is shorted out due to current diversion.

In yet another embodiment, a lighting apparatus based on multiple series-connected LEDs, one or more controllable current paths connected in parallel with one or more of the series-connected LEDs, and a controller to control one or more of the controllable current paths, may be implemented as one or more integrated circuits. Furthermore, integrated circuit implementations may be appropriately packaged for ease of installation, deployment, and/or use in any one of a number of applications, including those applications in which conventional operating voltages are readily available. For example, in one embodiment, an LED-based lighting unit including multiple series-connected LEDs, one or more controllable current paths in parallel with one or more of the LEDs, and a controller to control the current paths may be implemented as one or more integrated circuits in a single package including one or more appropriate electrical connectors that may be readily coupled directly to a power source at any one of a number of conventional operating voltages (e.g., for automotive applications, nominally 12 to 14 Volts DC).

In sum, one embodiment of the present invention is directed to an apparatus, comprising at least two LEDs connected in series between a first node and a second node, wherein a series current flows between the first node and the second node when an operating voltage is applied across the first node and the second node. The apparatus further comprises at least one controllable current path connected in parallel with at least a first LED of the at least two LEDs for at least partially diverting the series current around the first LED. The apparatus further comprises at least one controller for monitoring at least one parameter representative of the operating voltage and determining a maximum number of LEDs of the at least two LEDs that can be energized by the operating voltage. The at least one controller controls the at least one controllable current path so as to increase an amount of the series current that is diverted around at least the first LED when the maximum number is less than a total number of all of the at least two LEDs connected in series.

Another embodiment is directed to a method of energizing a plurality of LEDs connected in series between a first node and a second node, wherein a series current flows between the first node and the second node when an operating voltage is applied across the first node and the second node. The method comprises: A) monitoring at least one parameter representative of the operating voltage; B) determining a maximum number of LEDs of the at least two LEDs that can be energized by the operating voltage; and C) when the maximum number is less than a total number of all of the at least two LEDs connected in series, shorting out at least one of the plurality of LEDs so that less than all of the plurality of LEDs are simultaneously energized.

Another embodiment is directed to an apparatus, comprising a plurality of LEDs connected in series between a first node and a second node, wherein a series current flows between the first node and the second node when an operating voltage is applied across the first node and the second node. The apparatus further comprises a plurality of controllable current paths, each current path connected in parallel with a corresponding one of the plurality of LEDs for diverting the series current around the corresponding one of the plurality of LEDs, and a current source connected in series with the plurality of LEDs between the first node and the second node for setting the series current. The apparatus further comprises at least one controller for monitoring at least one parameter related to the operating voltage and for intermittently controlling the plurality of controllable current paths so as to divert the series current around respective corresponding ones of the plurality of LEDs in a timed sequence when the at least one monitored parameter indicates that the operating voltage is less than a predetermined threshold value, such that less than all of the plurality of LEDs are simultaneously energized.

Another embodiment is directed to an automotive lighting apparatus, comprising at least one integrated circuit chip. The at least one integrated circuit chip comprises: i) a first number of LEDs connected in series between a first node and a second node, wherein a series current flows between the first node and the second node when an operating voltage is applied across the first node and the second node; ii) a second number of controllable current paths, wherein the second number is equal to or less than the first number, each current path connected in parallel with a corresponding one of the first number LEDs for diverting the series current around the corresponding one of the first number of LEDs; iii) a current source connected in series with the first number of LEDs between the first node and the second node for setting the series current; and (iv) at least one controller for monitoring at least one parameter representative of the operating voltage and determining a maximum number of LEDs of the first number of LEDs that can be energized by the operating voltage. The at least one controller controls the second number of controllable current paths so as to divert the series current around respective corresponding ones of the first number of LEDs when the maximum number is less than the first number, such that less than all of the first number of LEDs are simultaneously energized. The automotive lighting apparatus further comprises a package for the at least one integrated circuit chip, the package including at least one first electrical connector configured to mate with a complimentary electrical connector or wire harness of an automobile. The at least one first electrical connector includes at least a first lead electrically connected to the first node and a second lead electrically connected to the second node for applying the operating voltage across the first node and the second node.

Relevant Terminology

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

Related Patents and Patent Applications

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001, entitled "Illumination Components;"

U.S. Pat. No. 6,608,453, issued Aug. 19, 2003, entitled "Methods and Apparatus for Controlling Devices in a Networked Lighting System;"

U.S. Pat. No. 6,777,891 issued Aug. 17, 2004, entitled ""Methods and Apparatus for Controlling Devices in a Networked Lighting System;" and U.S. patent application Ser. No. 11/836,560, filed Aug. 9, 2007, entitled "Methods and Apparatus for Simulating Resistive Loads."

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Various embodiments of the present invention are described below, including certain embodiments relating particularly to LED-based light sources. It should be appreciated, however, that the present disclosure is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

Figure 1:
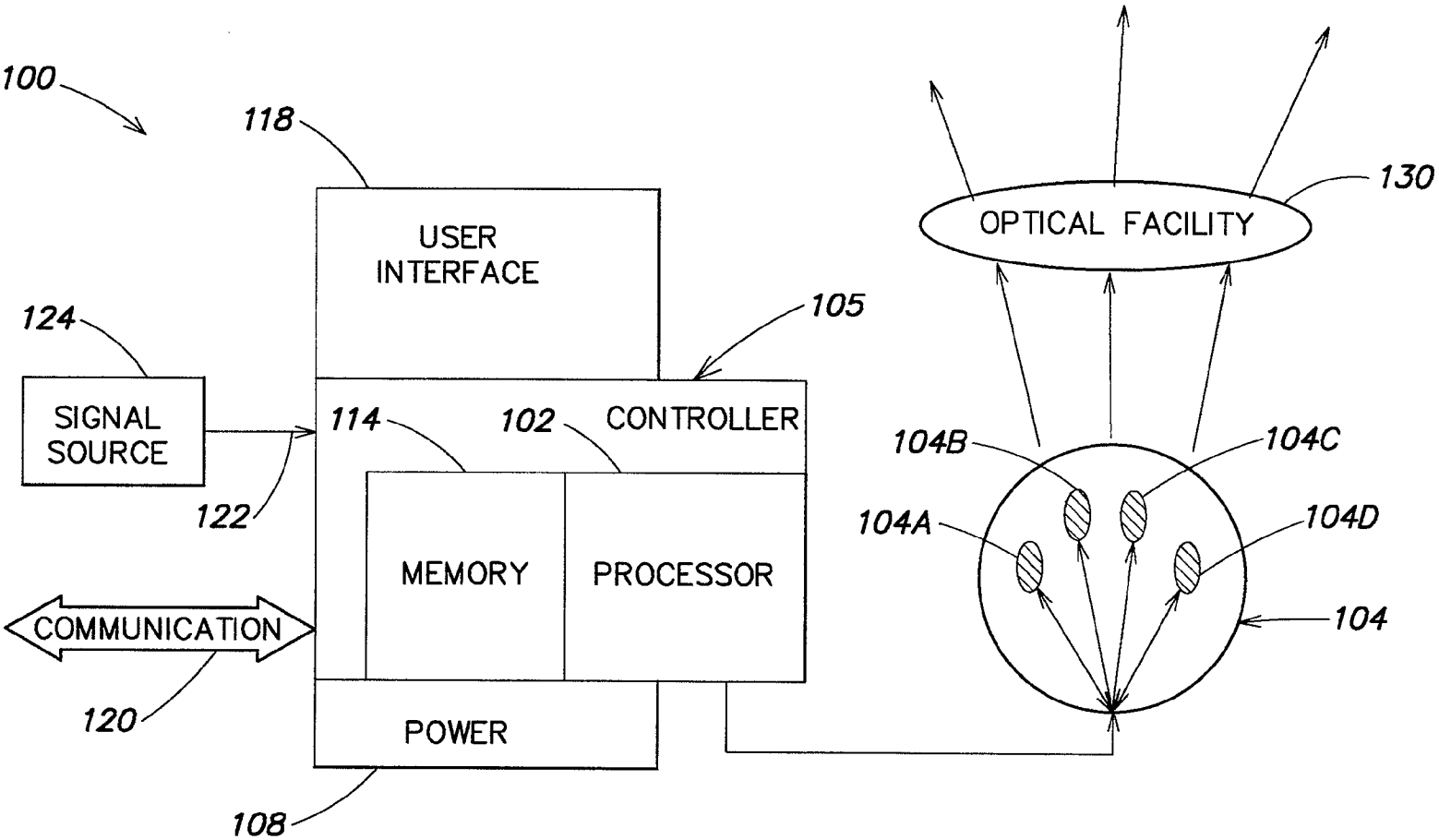
FIG. 1 is a diagram illustrating a lighting unit in accordance with various embodiments of the invention.

FIG. 1 illustrates one example of a lighting unit 100 according to one embodiment of the present disclosure. Some general examples of LED-based lighting units similar to those that are described below in connection with FIG. 1 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

The lighting unit 100 shown in FIG. 1 may be used alone or together with other similar lighting units in a system of lighting units (e.g., as discussed further below in connection with FIG. 2). Used alone or in combination with other lighting units, the lighting unit 100 may be employed in a variety of applications including, but not limited to, direct-view or indirect-view interior or exterior space (e.g., architectural) lighting and illumination in general, direct or indirect illumination of objects or spaces, theatrical or other entertainment-based/special effects lighting, decorative lighting, safety-oriented lighting, vehicular lighting, lighting associated with, or illumination of, displays and/or merchandise (e.g. for advertising and/or in retail/consumer environments), combined lighting or illumination and communication systems, etc., as well as for various indication, display and informational purposes. Additionally, one or more lighting units similar to that described in connection with FIG. 1 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

In various implementations and embodiments, the lighting unit 100 shown in FIG. 1 includes one or more light sources 104A, 104B, 104C, and 104D (shown collectively as 104), wherein one or more of the light sources may be an LED-based light source that includes one or more light emitting diodes (LEDs). In one aspect of this embodiment, any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 1 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 1, the lighting unit 100 also may include a controller 105 that is configured to output one or more control signals to drive the light sources so as to generate various intensities of light from the light sources. For example, in one implementation, the controller 105 may be configured to output at least one control signal for each light source so as to independently control the intensity of light (e.g., radiant power in lumens) generated by each light source; alternatively, the controller 105 may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In another aspect, the controller 105 may control other dedicated circuitry (not shown in FIG. 1) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches, not shown in FIG. 1, controlled by the controller 105. While the voltage $V_{source}$ is applied across the light source, a predetermined fixed current $I_{source}$ (e.g., determined by a current regulator, also not shown in FIG. 1) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed. According to the PWM technique, by periodically applying the voltage $V_{source}$ to the light source and varying the time the voltage is applied during a given on-off cycle, the average power delivered to the light source over time (the average operating power) may be modulated. In particular, the controller 105 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 105 may be configured to control each different light source channel of a multi-channel lighting unit at a predetermined average operating power to provide a corresponding radiant output power for the light generated by each channel. Alternatively, the controller 105 may receive instructions (e.g., "lighting commands") from a variety of origins, such as a user interface 118, a signal source 124, or one or more communication ports 120, that specify prescribed operating powers for one or more channels and, hence, corresponding radiant output powers for the light generated by the respective channels. By varying the prescribed operating powers for one or more channels (e.g., pursuant to different instructions or lighting commands), different perceived colors and brightness levels of light may be generated by the lighting unit.

In one embodiment of the lighting unit 100, as mentioned above, one or more of the light sources 104A, 104B, 104C, and 104D shown in FIG. 1 may include a group of multiple LEDs or other types of light sources (e.g., various parallel and/or serial connections of LEDs or other types of light sources) that are controlled together by the controller 105. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 1, the lighting unit 100 may be constructed and arranged to produce a wide range of variable color radiation. For example, in one embodiment, the lighting unit 100 may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the controller 105). Furthermore, the controller 105 may be particularly configured to provide control signals to one or more of the light sources so as to generate a variety of static or time-varying (dynamic) multi-color (or multi-color temperature) lighting effects. To this end, in one embodiment, the controller may include a processor 102 (e.g., a microprocessor) programmed to provide such control signals to one or more of the light sources. In various aspects, the processor 102 may be programmed to provide such control signals autonomously, in response to lighting commands, or in response to various user or signal inputs.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Additionally, multiple white LEDs having different color temperatures (e.g., one or more first white LEDs that generate a first spectrum corresponding to a first color temperature, and one or more second white LEDs that generate a second spectrum corresponding to a second color temperature different than the first color temperature) may be employed, in an all-white LED lighting unit or in combination with other colors of LEDs. Such combinations of differently colored LEDs and/or different color temperature white LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 1, the lighting unit 100 also may include a memory 114 to store information. For example, the memory 114 may be employed to store one or more lighting commands or programs for execution by the processor 126 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

Still referring to FIG. 1, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission. In one implementation, the controller 105 of the lighting unit monitors the user interface 118 and controls one or more of the light sources 104A, 104B, 104C and 104D based at least in part on a user's operation of the interface. For example, the controller 105 may be configured to respond to operation of the user interface by originating one or more control signals for controlling one or more of the light sources. Alternatively, the processor 126 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the controller 105. In one aspect of this implementation, the controller 105 is configured to monitor the power as controlled by the user interface, and in turn control one or more of the light sources based at least in part on a duration of a power interruption caused by operation of the user interface. As discussed above, the controller may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 1 also illustrates that the lighting unit 100 may be configured to receive one or more signals 122 from one or more other signal sources 124. In one implementation, the controller 105 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface.

Examples of the signal(s) 122 that may be received and processed by the controller 105 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. In one embodiment, a signal from one lighting unit 100 could be sent over a network to another lighting unit 100.

Some examples of a signal source 124 that may be employed in, or used in connection with, the lighting unit 100 of FIG. 1 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, another controller or processor, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 1 also may include one or more optical elements 130 to optically process the radiation generated by the light sources 104A, 104B, 104C, and 104D. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 1, the lighting unit 100 may include one or more communication ports 125 to facilitate coupling of the lighting unit 100 to any of a variety of other devices. For example, one or more communication ports 125 may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 2), as data is communicated via the network, the controller 105 of each lighting unit coupled to the network may be configured to be responsive to particular data (e.g., lighting control commands) that pertain to it (e.g., in some cases, as dictated by the respective identifiers of the networked lighting units). Once a given controller identifies particular data intended for it, it may read the data and, for example, change the lighting conditions produced by its light sources according to the received data (e.g., by generating appropriate control signals to the light sources). In one aspect, the memory 127 of each lighting unit coupled to the network may be loaded, for example, with a table of lighting control signals that correspond with data the processor 126 of the controller receives. Once the processor 126 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. In the DMX protocol, lighting instructions are transmitted to a lighting unit as control data that is formatted into packets including 512 bytes of data, in which each data byte is constituted by 8-bits representing a digital value of between zero and 255. These 512 data bytes are preceded by a "start code" byte. An entire "packet" including 513 bytes (start code plus data) is transmitted serially at 250 kbit/s pursuant to RS-485 voltage levels and cabling practices, wherein the start of a packet is signified by a break of at least 88 microseconds.

In the DMX protocol, each data byte of the 512 bytes in a given packet is intended as a lighting command for a particular "channel" of a multi-channel lighting unit, wherein a digital value of zero indicates no radiant output power for a given channel of the lighting unit (i.e., channel off), and a digital value of 255 indicates full radiant output power (100% available power) for the given channel of the lighting unit (i.e., channel full on). For example, in one aspect, considering for the moment a three-channel lighting unit based on red, green and blue LEDs (i.e., an "R-G-B" lighting unit), a lighting command in DMX protocol may specify each of a red channel command, a green channel command, and a blue channel command as eight-bit data (i.e., a data byte) representing a value from 0 to 255. The maximum value of 255 for any one of the color channels instructs the processor 102 to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

Thus, a given communication link employing the DMX protocol conventionally can support up to 512 different lighting unit channels. A given lighting unit designed to receive communications formatted in the DMX protocol generally is configured to respond to only one or more particular data bytes of the 512 bytes in the packet corresponding to the number of channels of the lighting unit (e.g., in the example of a three-channel lighting unit, three bytes are used by the lighting unit), and ignore the other bytes, based on a particular position of the desired data byte(s) in the overall sequence of the 512 data bytes in the packet. To this end, DMX-based lighting units may be equipped with an address selection mechanism that may be manually set by a user/installer to determine the particular position of the data byte(s) that the lighting unit responds to in a given DMX packet.

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

For example, in another embodiment, the processor 102 of a given lighting unit may be configured to interpret lighting instructions/data that are received in a conventional Ethernet protocol (or similar protocol based on Ethernet concepts). Ethernet is a well-known computer networking technology often employed for local area networks (LANs) that defines wiring and signaling requirements for interconnected devices forming the network, as well as frame formats and protocols for data transmitted over the network. Devices coupled to the network have respective unique addresses, and data for one or more addressable devices on the network is organized as packets. Each Ethernet packet includes a "header" that specifies a destination address (to where the packet is going) and a source address (from where the packet came), followed by a "payload" including several bytes of data (e.g., in Type II Ethernet frame protocol, the payload may be from 46 data bytes to 1500 data bytes). A packet concludes with an error correction code or "checksum." As with the DMX protocol discussed above, the payload of successive Ethernet packets destined for a given lighting unit configured to receive communications in an Ethernet protocol may include information that represents respective prescribed radiant powers for different available spectra of light (e.g., different color channels) capable of being generated by the lighting unit.

In yet another embodiment, the processor 102 of a given lighting unit may be configured to interpret lighting instructions/data that are received in a serial-based communication protocol as described, for example, in U.S. Pat. No. 6,777,891. In particular, according to one embodiment based on a serial-based communication protocol, multiple lighting units 100 are coupled together via their communication ports 120 to form a series connection of lighting units (e.g., a daisy-chain or ring topology), wherein each lighting unit has an input communication port and an output communication port. Lighting instructions/data transmitted to the lighting units are arranged sequentially based on a relative position in the series connection of each lighting unit. It should be appreciated that while a lighting network based on a series interconnection of lighting units is discussed particularly in connection with an embodiment employing a serial-based communication protocol, the disclosure is not limited in this respect, as other examples of lighting network topologies contemplated by the present disclosure are discussed further below in connection with FIG. 3.

In one embodiment employing a serial-based communication protocol, as the processor 102 of each lighting unit in the series connection receives data, it "strips off" or extracts one or more initial portions of the data sequence intended for it and transmits the remainder of the data sequence to the next lighting unit in the series connection. For example, again considering a serial interconnection of multiple three-channel (e.g., "R-G-B") lighting units, three multi-bit values (one multi-bit value per channel) are extracted by each three-channel lighting unit from the received data sequence. Each lighting unit in the series connection in turn repeats this procedure, namely, stripping off or extracting one or more initial portions (multi-bit values) of a received data sequence and transmitting the remainder of the sequence. The initial portion of a data sequence stripped off in turn by each lighting unit may include respective prescribed radiant powers for different available spectra of light (e.g., different color channels) capable of being generated by the lighting unit. As discussed above in connection with the DMX protocol, in various implementations each multi-bit value per channel may be an 8-bit value, or other number of bits (e.g., 12, 16, 24, etc.) per channel, depending in part on a desired control resolution for each channel.

In yet another exemplary implementation of a serial-based communication protocol, rather than stripping off an initial portion of a received data sequence, a flag is associated with each portion of a data sequence representing data for multiple channels of a given lighting unit, and an entire data sequence for multiple lighting units is transmitted completely from lighting unit to lighting unit in the serial connection. As a lighting unit in the serial connection receives the data sequence, it looks for the first portion of the data sequence in which the flag indicates that a given portion (representing one or more channels) has not yet been read by any lighting unit. Upon finding such a portion, the lighting unit reads and processes the portion to provide a corresponding light output, and sets the corresponding flag to indicate that the portion has been read. Again, the entire data sequence is transmitted completely from lighting unit to lighting unit, wherein the state of the flags indicate the next portion of the data sequence available for reading and processing.

In one embodiment relating to a serial-based communication protocol, the controller 105 a given lighting unit configured for a serial-based communication protocol may be implemented as an application-specific integrated circuit (ASIC) designed to specifically process a received stream of lighting instructions/data according to the "data stripping/extraction" process or "flag modification" process discussed above. More specifically, in one exemplary embodiment of multiple lighting units coupled together in a series interconnection to form a network, each lighting unit includes an ASIC-implemented controller 105 having the functionality of the processor 102, the memory 114 and communication port (s) 120 shown in FIG. 1 (optional user interface 118 and signal source 124 of course need not be included in some implementations). Such an implementation is discussed in detail in U.S. Pat. No. 6,777,891.

In one embodiment, the light source 104 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices or power conversion circuitry (e.g., in some cases internal to the light source 104) that convert power received by an external power source to a form suitable for operation of the various internal circuit components and light sources of the light source 104. In one exemplary implementation discussed in U.S. Pat. No. 7,256,554, entitled "LED Power Control Methods and Apparatus;" incorporated herein by reference, the controller 105 of the light source 104 may be configured to accept a standard A.C. line voltage from the power source 108 and provide appropriate D.C. operating power for the light sources and other circuitry of the lighting unit based on concepts related to DC-DC conversion, or "switching" power supply concepts. In one aspect of such implementations, the controller 105 may include circuitry to not only accept a standard A.C. line voltage but to ensure that power is drawn from the line voltage with a significantly high power factor.

Figure 2:
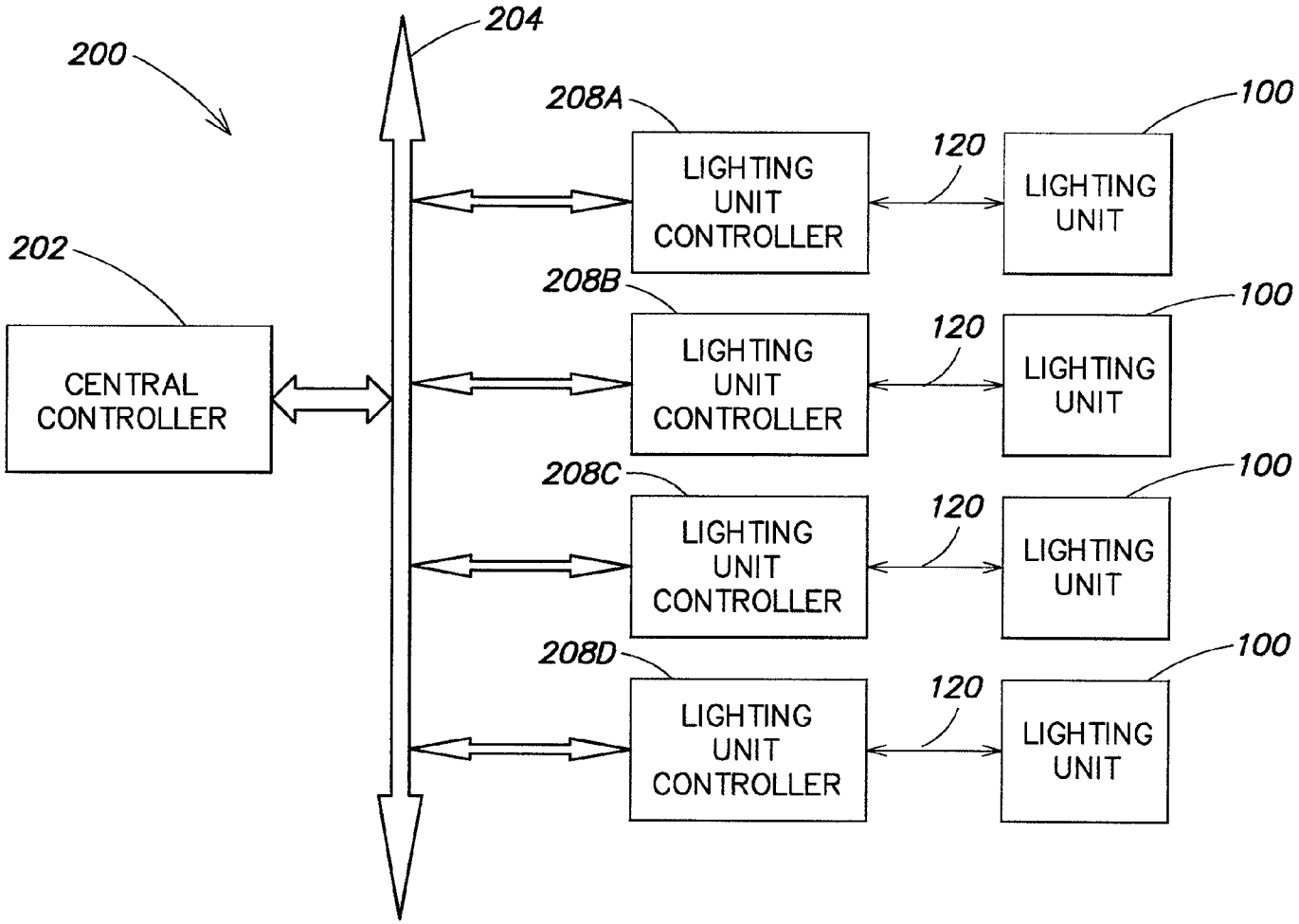
FIG. 2 is a diagram illustrating a networked lighting system according to various embodiment of the invention.

FIG. 2 illustrates an example of a networked lighting system 200 according to one embodiment of the present disclosure. In the embodiment of FIG. 2, a number of lighting units 100, similar to those discussed above in connection with FIG. 1, are coupled together to form the networked lighting system. It should be appreciated, however, that the particular configuration and arrangement of lighting units shown in FIG. 2 is for purposes of illustration only, and that the disclosure is not limited to the particular system topology shown in FIG. 2.

Additionally, while not shown explicitly in FIG. 2, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 1) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 2, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 2 illustrates one lighting unit 100 coupled to each LUC, it should be appreciated that the disclosure is not limited in this respect, as different numbers of lighting units 100 may be coupled to a given LUC in a variety of different configurations (serially connections, parallel connections, combinations of serial and parallel connections, etc.) using a variety of different communication media and protocols.

In the system of FIG. 2, each LUC in turn may be coupled to a central controller 202 that is configured to communicate with one or more LUCs. Although FIG. 2 shows four LUCs coupled to the central controller 202 via a generic connection 212 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present disclosure, the central controller 202 shown in FIG. 2 may by configured to implement Ethernet-based communications with the LUCs, and in turn the LUCs may be configured to implement one of Ethernet-based, DMX-based, or serial-based protocol communications with the lighting units 100 (as discussed above, exemplary serial-based protocols suitable for various network implementation are discussed in detail in U.S. Pat. No. 6,777,891. In particular, in one aspect of this embodiment, each LUC may be configured as an addressable Ethernet-based controller and accordingly may be identifiable to the central controller 202 via a particular unique address (or a unique group of addresses and/or other identifiers) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via an Ethernet, DMX, or serial-based protocol, in response to the Ethernet communications with the central controller 202 (wherein the lighting units are appropriately configured to interpret information received from the LUC in the Ethernet, DMX, or serial-based protocols).

The LUCs 208A, 208B, and 208C shown in FIG. 2 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using any one of a variety of protocols (e.g., Ethernet, DMX, serial-based), in response to which the respective sources of the lighting units are controlled via any of a variety of signaling techniques (e.g., PWM).

Also, one or more LUCs of a lighting network may be coupled to a series connection of multiple lighting units 100 (e.g., see LUC 208A of FIG. 2, which is coupled to two series-connected lighting units 100). For example, each LUC coupled in this manner is configured to communicate with the multiple lighting units using a serial-based communication protocol, examples of which were discussed above. More specifically, in one exemplary implementation, a given LUC may be configured to communicate with a central controller 202, and/or one or more other LUCs, using an Ethernet-based protocol, and in turn communicate with the multiple lighting units using a serial-based communication protocol. In this manner, a LUC may be viewed in one sense as a protocol converter that receives lighting instructions or data in the Ethernet-based protocol, and passes on the instructions to multiple serially-connected lighting units using the serial-based protocol. Of course, in other network implementations involving DMX-based lighting units arranged in a variety of possible topologies, it should be appreciated that a given LUC similarly may be viewed as a protocol converter that receives lighting instructions or data in the Ethernet protocol, and passes on instructions formatted in a DMX protocol.

It should again be appreciated that the foregoing example of using multiple different communication implementations (e.g., Ethernet/DMX) in a lighting system according to one embodiment of the present disclosure is for purposes of illustration only, and that the disclosure is not limited to this particular example.

From the foregoing, it may be appreciated that one or more lighting units as discussed above are capable of generating highly controllable variable color light over a wide range of colors, as well as variable color temperature white light over a wide range of color temperatures.

As discussed earlier, it is often useful to consider the connection of multiple lighting units or light sources (e.g. LEDs) to receive operating power in series rather than in parallel. A series interconnection of multiple LEDs may permit the use of operating voltages that are significantly higher than typical LED forward voltages, and may also allow operation of multiple LEDs or LED-based lighting units without requiring a transformer between a source of power (e.g., wall power or line voltage such as 120 VAC or 240 VAC) and the loads (i.e., multiple series-connected loads may be operated "directly" from a line voltage).

Accordingly, other embodiments of the present invention generally relate to methods and apparatus for controlling LED-based light sources, in which respective elements of a multi-element light source, and/or multiple light sources themselves, are coupled in series to receive operating power. In various embodiment discussed further below, it should be appreciated that virtually any appropriate number of LEDs or LED-based lighting units may be coupled in series depending at least in part on the nominal operating voltage of each LED or lighting unit, and the expected nominal supply voltage provided by an available source of power. For purposes of the discussion below, various concepts relating to series-connected LEDs are discussed first; however, it should be appreciated that many if not all of the concepts discussed herein similarly may be applied to various groupings of LEDs (serial, parallel, and/or serial/parallel arrangements), as well as multiple LED-based lighting units, that are coupled in series to receive operating power.

Figure 3:
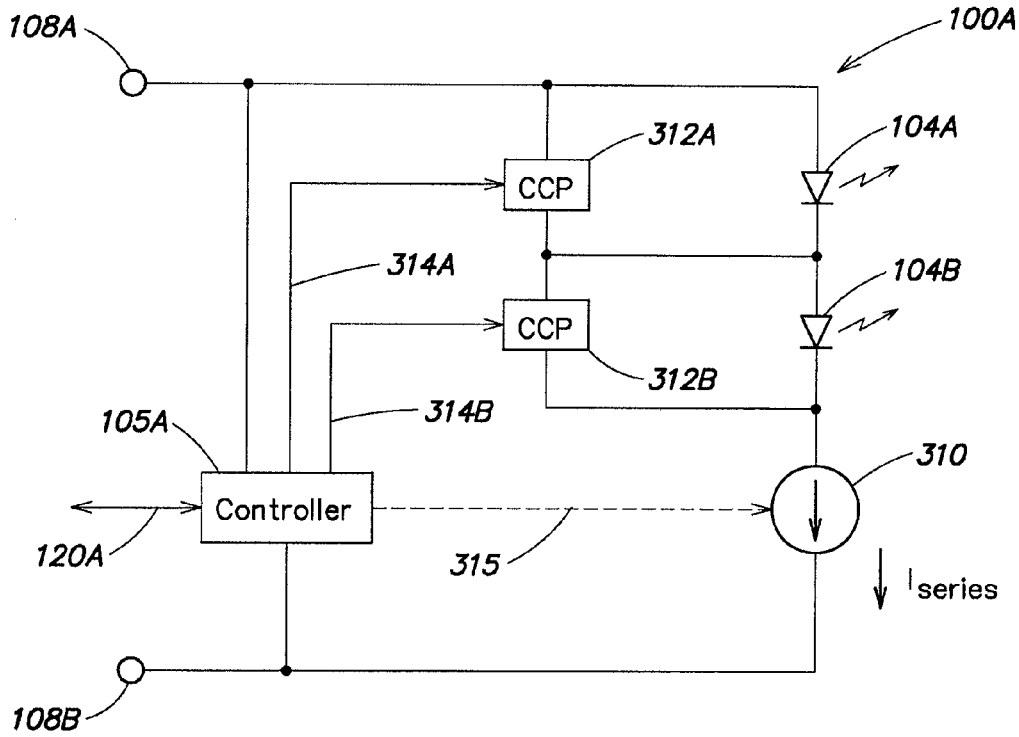
FIG. 3 is a block diagram of a lighting apparatus including multiple series-connected LEDs and one or more controllable current paths, according to one embodiment of the invention.

FIG. 3 is a block diagram of an LED-based lighting apparatus 100A including multiple series-connected LEDs, according to one embodiment of the present invention. In the apparatus of FIG. 3, multiple LEDs are connected nominally in series between a first node 108A and a second node 108B to which an operating voltage is applied (a power source 108 was generally discussed above in connection with FIG. 1) to form a series-connected "stack" of devices. For purposes of the following discussion, the position of one or more LEDs in the "stack" of series-connected devices, relative to one of the two voltage potentials respectively applied to the first and second nodes, is referred to as the "height" in the "stack."

In FIG. 3, a first light source 104B (represented by a single LED for purposes of illustration) is shown at a first height in the stack, and a second light source 104A (again represented by a single LED for purposes of illustration) is shown at a second height in the stack. While FIG. 3 illustrates an exemplary apparatus with two light sources, as noted above it should be appreciated that the present invention is not limited in this respect, as virtually any number of light sources may connected in series in a given apparatus. FIG. 3 also shows a current source 310 connected in series with the LEDs between the first and second nodes; in one aspect, the current source 310 sets a series current ($I_{series}$) flowing between the first and second nodes, through one or more of the series-connected LEDs, when the operating voltage is applied across the first and second nodes.

As discussed above in connection with FIG. 1, in various implementations the light sources 104A and 104B of the apparatus 100A shown in FIG. 3 each may include a single LED or multiple LEDs (e.g., interconnected in a parallel arrangement). Additionally, the light sources 104A and 104B may generate radiation having similar or virtually identical spectrums (e.g., constituting colored or essentially white light), or the light sources 104A and 104B may generate respectively different spectrums. Accordingly, at each different height in the stack of series-connected devices, in different implementations one or more LEDs may be employed; furthermore, different spectrums of colored light (or different color temperatures of white light) may be generated at different heights in the stack, or essentially a same spectrum of light may be generated at each height in the stack. Again, for purposes of illustration in the discussion that follows, each of the light sources 104A and 104B in FIG. 3 is referred to simply as an LED, although it should be appreciated that various implementations of the present invention are not limited to having a single LED at each height in the stack of series-connected devices.

As also shown in FIG. 3, the apparatus 100A includes one or more controllable current paths 312A and 312B (abbreviated as "CCP") connected in parallel with one or more of the series-connected LEDs. In various aspects, the controllable current paths may be implemented as controllable switches to completely divert the series current $I_{series}$ around a given LED, or as controllable variable or fixed current sources configured to divert all or only a portion of the series current around the given LED. In this manner, the brightness of a given LED may be controlled and, in the extreme, the LED may be completely turned off by diverting current completely around it. While FIG. 3 illustrates a one-to-one correspondence between the controllable current paths 312A and 312B and the LEDs 104A and 104B, it should be appreciated that the invention is not limited in this respect. In particular, according to various embodiments discussed further below, each LED in the series connection need not be associated with a dedicated/corresponding controllable current path; rather, in some implementations, no controllable current path may be associated with one or more LEDs of the series connection, and/or a given controllable current path may be associated with multiple LEDs of the series connection.

In another aspect of the embodiment shown in FIG. 3, the apparatus 100A includes a controller 105A configured to control one or more controllable current paths 312A and 312B via the respective control signals 314A and 314B. In FIG. 3, the controller is shown coupled to the operating voltage applied across the first and second nodes so as to obtain operating power. Alternatively, the controller 105A may be coupled in series with the current source 310 and the series-connected LEDs so as to obtain operating power. In one implementation, the controller 105A may operate one or more controllable current paths 312A and 312B based on data received as lighting instructions via one or more communication ports 120A (as discussed above in connection with FIGS. 1 and 2). To this end, the controller may be configured to be responsive to a serial data protocol, and include at least two communication ports (e.g., an data input port and a data output port) to facilitate serial data communication amongst respective controllers of multiple lighting apparatus similar to the apparatus 100A.

In another implementation, the controller 105A may be configured to operate one or more controllable current paths based on one or more measured parameters related to the available operating voltage applied across the first and second nodes 108A and 108B. More specifically, in one embodiment, the ability to divert current partially or fully around one or more series-connected LEDs is employed in circumstances in which a nominal expected operating voltage applied across the first and second nodes falls below a minimum operating voltage necessary to energize all of the series-connected devices. In various implementations, this minimum operating voltage may depend at least in part on the number and type of LEDs employed in the series-connected stack of devices and, more specifically, the respective forward operating voltages of the individual LEDs employed in the stack.

In view of the foregoing, in one embodiment the controller 105A of the apparatus 100A shown in FIG. 3 controls one or more of the controllable current paths based at least in part on one or more monitored parameters representative of an available operating voltage for the series-connected LEDs. From the monitored parameter(s), the controller determines a maximum number of the series-connected LEDs that can be energized by the operating voltage, and controls one or more of the controllable current paths so as to increase an amount of the series current that is diverted around one or more of the series-connected LEDs when the maximum number is less than a total number of all of the series-connected LEDs. For example, in one implementation, the controllable current paths may be switches that completely divert current around a corresponding LED so as to essentially short out the LED and remove it from the series connection of devices. In this manner, the operating voltage necessary to operate the remaining series-connected LEDs is lowered by the individual operating (forward) voltage of each LED that is shorted out due to current diversion.

In some exemplary implementations, the controller may be configured to control one or more of the controllable current paths so as to increase an amount of current that is diverted around a corresponding LED (e.g., short out the corresponding LED) when the monitored parameter(s) indicate that the operating voltage is less than a predetermined threshold value. In one aspect, the predetermined threshold value may represent a minimum operating voltage necessary to energize all of the series-connected LEDs in a given apparatus and, in this manner, may depend at least in part on the number of LEDs in a given apparatus and the respective forward voltages of the LEDs. Likewise, if at some point the operating voltage is below some predetermined threshold value and then increases above the threshold value, the controller may appropriately control one or more of the controllable current paths to add one or more "shorted" LEDs back into the series-connected stack so that they are energized by the series current. More generally, via the monitored parameter(s) representative of the operating voltage, the controller may make a determination (and may do so virtually continuously or periodically) as to the number of LEDs that may be effectively energized based on the available operating voltage at any given time, and control one or more controllable current paths accordingly to energize all or less than all of the series-connected LEDs of the apparatus. As discussed further below, the controller 105A may implement a variety of control strategies for statically or dynamically controlling one or more of the controllable current paths over a given time period and/or range of operating voltage conditions.

In yet other aspects of the apparatus 100A shown in FIG. 3, the current source 310 may be a fixed current source (i.e., the value of the series current $I_{series}$ may be fixed), or the current source may be a controllable current source such that the series current $I_{series}$ is variable. To this end, in one embodiment the controller 105A may additionally control the current source 310, as indicated by the dashed control connection 315 shown in FIG. 3. In various respects, the controller may control the current source to set the series current based at least in part on the monitored parameter(s) representing the operating voltage, and to increase or decrease the series current based on changes in the available operating voltage according to any of a variety of relationships (e.g., proportional, inversely proportional, etc.). For example, the controller may be configured to control the current source so as to increase the series current as the operating voltage decreases so as to maintain an essentially constant brightness of light generated by energized LEDs of the apparatus. The controller 105A may also change the value of series current to reduce brightness, or otherwise change the series current based on a change in the operating voltage. Various dynamic relationships between the series current and the operating voltage may be effected by the controller 105A; for example, in one implementation, the series current may be slowly reduced as the operating voltage decreases, but then increased by some amount (e.g., 25%) when the LED shorting process begins. In this manner, there would be no sudden decrease in overall brightness as the operating voltage decreases. In yet another aspect, the controller 105A may control the current source 310 so as to duty cycle modulate the series current, to provide either a fixed or variable average series current.

Figure 4:
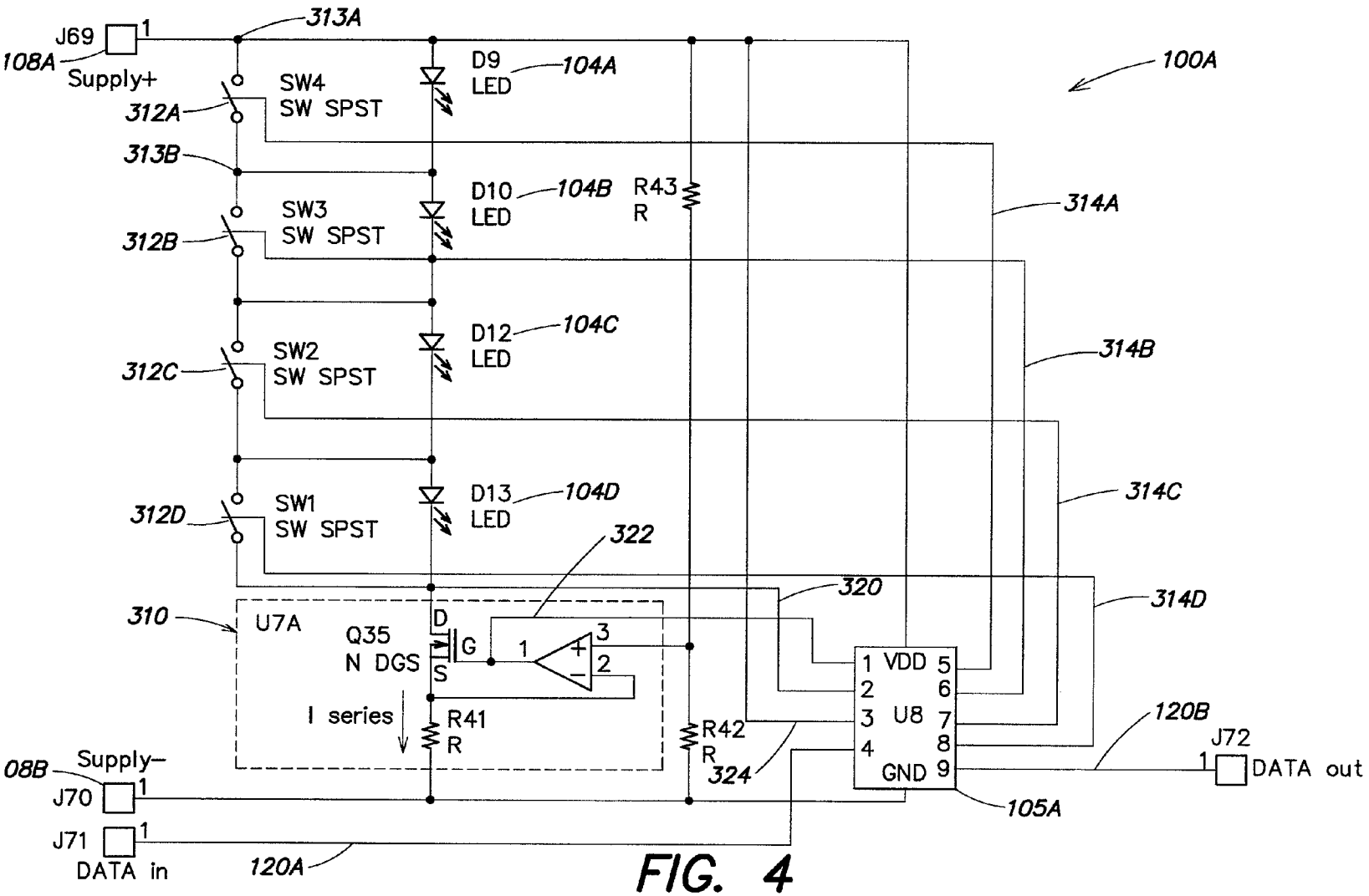
FIG. 4 is a diagram illustrating an exemplary circuit implementation of the lighting apparatus shown in FIG. 3, according to one embodiment of the present invention.
Figures 5A, 5B, 5C, 5D:
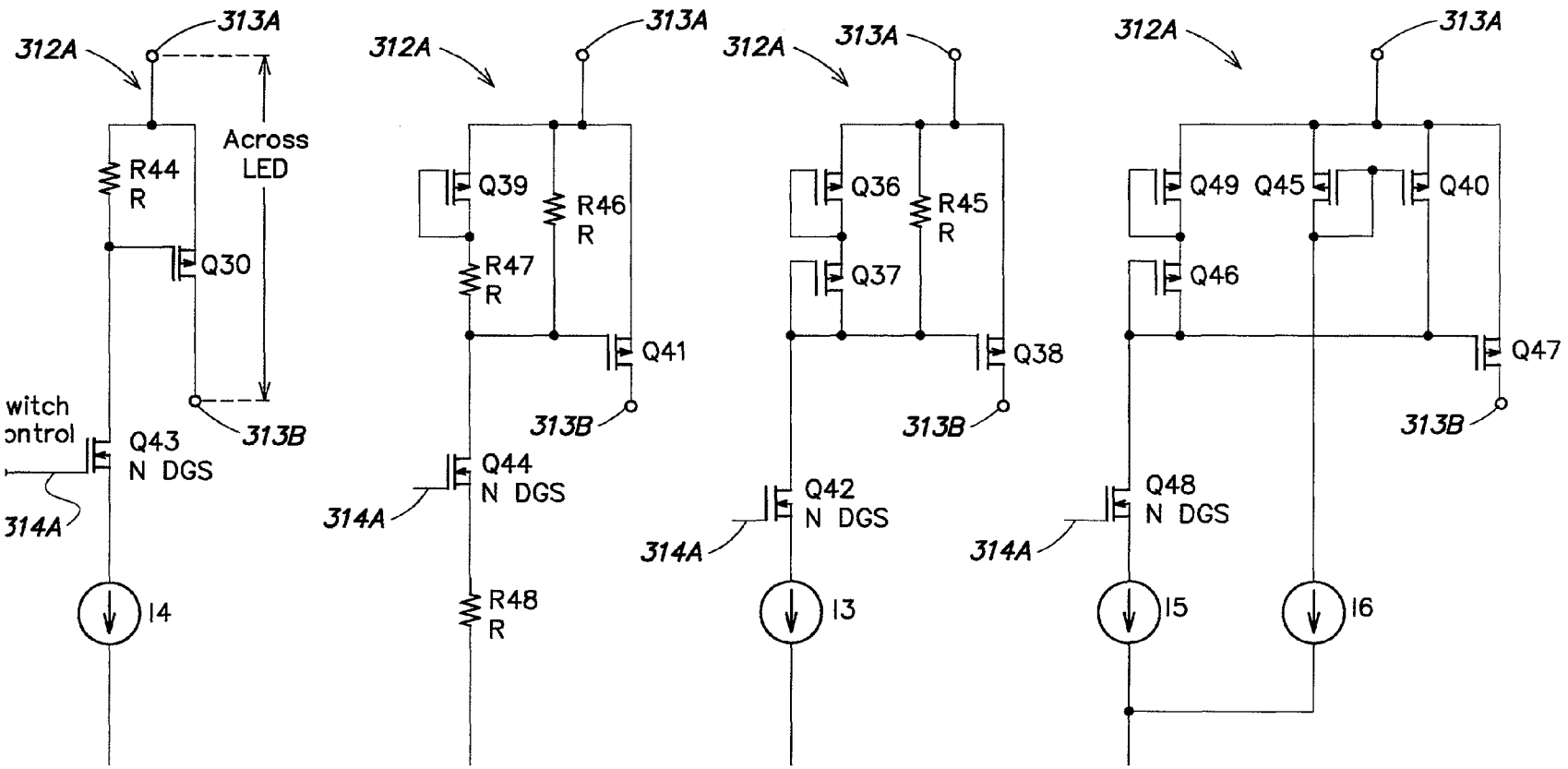
FIGS. 5A-5D illustrate respective examples of controllable current paths suitable for use in the circuit of FIG. 4, according to various embodiments of the present invention.

FIG. 4 is a diagram illustrating an exemplary circuit implementation of the apparatus 100A shown in FIG. 3, according to one embodiment of the present invention. In one aspect of this embodiment, the apparatus of FIG. 4 is particularly well-suited for automotive lighting applications in which nominal expected operating voltages are in the range of approximately 12 to 14.5 Volts. In particular, in automotive applications based on an electrical system including a conventional 12 Volt automobile battery, the available operating voltage for automobile accessories when an engine is running and the electrical system is charging typically is between 13.8 to 14.5 Volts; however, when the engine is not running, the available operating voltage can drop quickly to 12 to 12.8 Volts, or even lower (e.g., when high loads are present, and/or as the automobile battery discharges further). With the foregoing in mind, consider a lighting apparatus similar to that shown in FIG. 3, in which four series-connected LEDs each having a forward voltage of approximately 3.0 to 3.3 Volts (e.g., based on GaN technology) are employed, such that a series-connected stack of all four LEDs, plus a current source in series with the LEDs, requires an operating voltage of approximately 13.0 to 13.5 Volts. In one aspect, an apparatus thusly configured is based on a principle of "constant area cost;" namely, an LED semiconductor structure of a fixed size costs a fairly fixed amount to implement, independent of how many sections into which it may be divided. Thus, if an LED semiconductor structure is divided into four sections which are then connected in series, a device results that has essentially the same cost as one LED, operates at a quarter of the current, and has an operating voltage four time that of the forward voltage of a single LED.

Of course, for automotive applications as discussed above, a lighting apparatus based on series-connected LEDs needs to take into consideration the complete range of possible available operating voltages; i.e., if the available operating voltage from the automobile electrical system falls below approximately 13.0 to 13.5 Volts, there may not be sufficient voltage to energize all of the four series-connected LEDs. To this end, in the circuit of FIG. 4, four series-connected LEDs 104A-104D are employed together with four controllable current paths 312A-312D, in parallel with the LEDs in a one-to-one correspondence, and responsive to corresponding control signals 314A-314D provided by the controller 105A. In FIG. 4, the controllable current paths are implemented as single-pole single-throw (SPST) switches SW1-SW4 so as to divert the series current $I_{series}$ around corresponding LEDs. The current source 310 is implemented by operational amplifier U7A, N-type field effect transistor Q35 and resistor R41. In the circuit of FIG. 4, the current source 310 is not under the control of the controller 105A, but rather the series current $I_{series}$ provided by the current source 310 tracks the operating voltage via the voltage divider formed by resistors R43 and R42.

As discussed above in connection with FIG. 3, the controller 105A in the circuit of FIG. 4 (U8) may be coupled between the first and second nodes 108A and 108B to obtain operating power directly from the operating voltage applied to these nodes. Additionally, the controller may optionally include a first communication port 120A and a second communication port 120B to transmit and receive data representing various information, as discussed further below. As also discussed above in connection with FIG. 3, the controller 105 in the circuit of FIG. 4 may implement a variety of control techniques to operate the controllable current paths formed by the switches SW1-SW4.

For example, as the operating voltage applied to the first and second nodes 108A and 108B decreases below a level required to appropriately energize all four LEDs 104A-104D, the controller 105A may begin controlling the switches SW1-SW4 so as to short out one LED at a time (e.g., in a timed sequence) so that all LEDs appear to remain lit to an observer; stated differently, as the operating voltage decreases to a level that is insufficient to appropriately provide power to four series-connected LEDs, only three or fewer of the LEDs are simultaneously energized at any given time. In this manner, the controller intermittently diverts the series current around respective LEDs. In one aspect, different groupings of less than four LEDs are successively energized in a manner that is generally imperceptible to an observer. In another aspect, more than one LED may be shorted at the same time to allow further reductions in operating voltage while still generating light from the apparatus (e.g., only two LEDs may be energized at any given time, with different groups of two LEDs successively energized at an appropriate rate so as to be generally imperceptible to an observer).

In the circuit of FIG. 4, the controller 105A may employ any one or more of a number of techniques for monitoring one or more parameters representative of the operating voltage applied between the nodes 108A and 108B, and determining an appropriate number of LEDs that may be energized so as to effectively control the controllable current paths implemented by the switches SW1-SW4. To this end, the controller 105A may include one or more inputs to receive signals to monitor one or more of the operating voltage itself (via the line 324), a drain voltage of the FET Q35 (via the line 320), and a gate voltage of the FET Q35 (via the line 322).

In one example, the controller 105A monitors both the gate voltage and the drain voltage of the FET Q35, wherein a relatively higher gate voltage indicates that the operating voltage has decreased and there may be a need to short out one or more LEDs, while a relatively higher drain voltage indicates that the operating voltage has increased and it may be possible to short out fewer LEDs. For example, in one particular implementation based on a nominal expected operating voltage of approximately 13.5-14.5 Volts (e.g., automotive applications), and an apparatus 100A including four series-connected LEDs, a gate voltage of approximately 4 Volts indicates that the operating voltage has fallen to a value at which it is necessary to short out at least one LED, and a drain voltage of approximately 5 Volts indicates a sufficient operating voltage to include all four LEDs in the series-connected stack. In another example, the controller 105A monitors only one of the drain and gate voltage of the FET Q35, and relies on accurate sensing of high and low drain voltages to achieve the decision, or speculative operation of the switches to determine the correct number of LEDs to short. In yet another example, the controller 105A may directly monitor the operating voltage, and employ a predictive strategy in which the monitored operating voltage maps directly to some number of shorted LEDs. To this end, in one embodiment the controller may employ one or more predetermined threshold values, and as the operating voltage falls below a given predetermined threshold value, one or more LEDs are required to be shorted out. Various other techniques may be used, including indirectly estimating the drain, source, and/or gate voltage of FET Q35, with the goal of determining the correct number of LEDs to short.

Although the controller 105A does not control the current source 310 in the circuit of FIG. 4, those of ordinary skill in the art will readily appreciate that, as discussed above in connection with FIG. 3, other circuit implementations may be realized in which the controller 105A may also change the value of the series current flowing through the string of energized LEDs, and may duty cycle modulate the current source, to maintain overall generated light brightness, reduce brightness, or otherwise change some aspect of operation of the apparatus based on a change in the operating voltage. Furthermore, in alternative implementations of the apparatus 100A based generally on the circuit architecture shown in FIG. 4, the current source may be implemented in any one of numerous ways known to those of ordinary skill in the relevant arts, including circuits employing one or more operational amplifiers, and n-type or p-type transistors such as BJTs or FETs. Likewise, the controllable current paths 312A-312D implemented as the switches SW1-SW4 may be of various designs.

For example, FIGS. 5A through 5D illustrate four non-limiting exemplary circuits, any one of which may for employed for implementing the switches SW1-SW4 shown in FIG. 4. For purposes of illustration, the circuit diagrams in FIGS. 5A-5D represent four different possibilities for the switch SW4 (controllable current path 312A) shown in FIG. 4, wherein the nodes 313A and 313B for connection across the LED 104A are indicated in the figures. It should be appreciated that any one of the switch designs shown in FIGS. 5A-5D may be employed for any one or more of the switches SW1-SW4 shown in FIG. 4. As with different implementations of the current source 310, the switches may include one or both of n-type or p-type devices. In other aspects, a capacitive charge pump or boost cap architecture may be employed to increase the available switch gate voltages.

While in one implementation the controller 105A of FIG. 4 may successively control different ones, or multiple different ones, of the switches SW1-SW4 in an intermittent manner, as discussed above it should be appreciated that a number of control techniques may be implemented by the controller 105A according to various embodiments so as to control the controllable current paths. For example, current paths may be controlled sequentially, according to some predetermined or random order and according to a variety of time scales. Of course, as noted above, in one implementation the rate at which different current paths are controlled may be selected to be sufficiently faster than the rate at which a typical observer is able to discern perceptible differences in light characteristics (e.g., greater than approximately 50-60 Hz). In other embodiments of lighting apparatus similar to those shown in FIGS. 3 and 4, a lighting apparatus may include one or more optical elements (e.g., as discussed above in connection with FIG. 1) to mix, diffuse, combine or otherwise optically process the light generated by respective LEDs, such that the resulting perceived light is relatively independent of which particular LEDs are energized at any given time.

Additionally, for some applications of the apparatus 100A shown in FIGS. 3 and 4, periodic, sequential or intermittent operation of the controllable current paths to switch one or more LEDs in and out of the series-connected stack, or otherwise divert some portion of current around one or more LEDs, may not be necessary; for example, there may be some applications in which it is acceptable to simply choose a particular operating state (e.g., some number of LEDs energized) based on available operating voltage at a given instant, and maintain that state for some period of time or indefinitely. To this end, it should be appreciated that whether or not some type of static or dynamic control technique is employed for the controllable current paths, two or more current paths may be controlled simultaneously. Likewise, available operating voltage may be monitored/sampled at any of a variety of intervals, and various control techniques implemented based on the sampled operating voltage.

In other aspects of the apparatus shown in FIG. 4, it should be appreciated that for some applications (including automotive and other applications), not all of the switches SW1-SW4 may be necessary (i.e., all of the series-connected LEDs need not necessarily be capable of being shorted out). For example, in conventional automotive electric systems, it may only be necessary to have the capability to short two or three LEDs of the four series-connected LEDs if operating voltages substantially lower than 10 to 12 Volts, or even as low as 5 Volts, are not routinely expected. Stated differently, as discussed above in connection with FIG. 3, it may be acceptable in some implementations to have one or more LEDs of the series-connected stack that are not associated with a corresponding controllable current path, and remain in the stack (and energized) at lower operating voltages, thereby further reducing the number of controllable current paths required.

In yet another aspect, the controller 105A may be configured to control the controllable current paths or switches SW1-SW4 such that the overall appearance of the generated light perceivably changes to an observer when the operating voltage is insufficient to operate all LEDs in the series-connected stack; i.e., it may be useful and/or desirable to make an observer aware of the reduced operating voltage through a perceivable change in the quality (e.g., brightness) of generated light. If different color LEDs are employed, this type of indication can be quite visible (i.e., quality changes in the light due to changes in operating voltage may involve brightness and color).

As also discussed above in connection with FIG. 3, in general it should be appreciated that the LEDs of the apparatus 100A shown in FIG. 4 may be of the same color (or color temperature of white) or different colors (or different color temperatures of white). In one embodiment, the physical arrangement of different color or color temperature LEDs in a given apparatus, and/or the control technique implemented by the controller 105A, may exploit the use of different color or different color temperature LEDs to create various lighting effects. More generally, the plurality of series-connected LEDs may include at least one first LED for generating first radiation having a first spectrum, and at least one second LED for generating second radiation having a second spectrum different than the first spectrum, and the controller may control the controllable current paths in a predetermined manner based at least in part on the different spectrums of the LEDs.

In one exemplary implementation, the first LED may include a first white LED, such that the first spectrum corresponds to a first color temperature, and the second LED may include a second white LED, such that the second spectrum corresponds to a second color temperature different than the first color temperature. In one aspect, the controller may control the controllable current paths such that an overall color temperature of the light generated by the apparatus, based on at least one of the first spectrum and the second spectrum, decreases as the operating voltage decreases. For example, if warm white LEDs are used in some positions and cool white LEDs are used in others, then the controller may be configured to preferentially maintain energized the warm LEDs as operating voltage is reduced to mimic the effect produced by an incandescent light bulb. If the light output of respective energized LEDs is sufficiently optically mixed, the switching action can be quite coarse, and still create a desired quality of light output. In other aspects, it may be convenient to have control over the series current provided by the current source 310, and/or to deliberately short out LEDs occasionally, even when there is sufficient operating voltage to operate all LEDs in the series-connected stack, to achieve adjustment of the resultant color, color temperature, and/or brightness of generated light.

Although four series-connected LEDs are shown in the apparatus of FIG. 4, the apparatus is not limited in this respect, as embodiments with fewer (as few as two) or more than four LEDs are contemplated according to the present disclosure, as discussed above in connection with FIG. 3. More generally, it should be appreciated that while an example of an automotive application was provided above in connection with the apparatus shown in FIG. 4, various implementations of the present invention are not necessarily limited to automotive applications nor the particular range of contemplated operating voltages for such applications. In one respect, the number of series-connected LEDs in an apparatus having similar construction and functionality to that shown in FIGS. 3 and 4 may be dictated in part by the nominal operating voltage and range of expected operating voltages in a given application. For example, while four LEDs each having a forward voltage of approximately 3.0 to 3.3 Volts may be particularly well-suited for operating voltages of approximately 13.0 to 14.5 Volts (e.g., as found in automotive applications), an apparatus based on two LEDs each having a forward voltage of from 2.5 to 3 VDC may be particularly well-suited for applications involving operating voltages of 6 to 9 VDC, and an apparatus having seven series-connected LEDs may be particularly well-suited for applications involving operating voltages of approximately 24 Volts. Again, apparatus according to the present invention including any number of LEDs may be contemplated for virtually any range of expected operating voltage for a variety of applications.

As also discussed above in connection with FIG. 3, more than one LED may be controlled by a given controllable current path, including groups of parallel-connected LEDs at a given height in the series-connected stack, or having a single controllable current path controlling LEDs at two or more heights in the series-connected stack (wherein, at each height, there may be one or more LEDs). Of course, it should be appreciated that as the number of LEDs per controlled group (e.g., at a given height in the stack) increases, the differential brightness of light generated by the apparatus increases as current is diverted around different heights in the stack. For example, in one implementation based on an operating voltage of 24 Volts, an apparatus may comprise seven series-connected LEDs and only five controllable current paths, wherein the LEDs are arranged as three controllable groups of two series-connected LEDs, in series with two individually controllable LEDs. In other implementations based on different controllable groupings of LEDs, even and odd number groups of LEDs at respective heights in the series-connected stack may be implemented such that the overall brightness of light generated by an apparatus may be adjusted in increments of one LED (i.e., without having any height in the stack with only a single controllable LED). Furthermore, in some embodiments, not all LEDs employed in a series-connected stack need to be controllable with respect to current diversion, as also discussed above in connection with FIG. 3. In one implementation based on one or more "fixed on" (uncontrollable) LEDs in a series-connected stack (in which the uncontrolled LEDs generally deliver more light than the other controlled LEDs which are presumed to be off in some circumstances), the physical layout of the LEDs in a realized device may be tailored to optimize optical efficiency (e.g., uncontrolled LEDs may be centered within the optical system).

In yet another embodiment, a lighting apparatus similar to that shown in FIGS. 3 and 4, based on multiple series-connected LEDs, one or more controllable current paths connected in parallel with one or more of the series-connected LEDs, and a controller to control one or more of the controllable current paths, may be implemented as one or more integrated circuits. Furthermore, integrated circuit implementations may be appropriately packaged for ease of installation, deployment, and/or use in any one of a number of applications, including those applications in which conventional operating voltages are readily available.

For example, in one embodiment related to the apparatus shown in FIG. 4, particularly in connection with automotive lighting applications, the apparatus may be implemented as one or more integrated circuits and included in a package that facilitates installation and use in an automotive environment. To this end, all of the components of the circuitry shown in FIG. 4 may be implemented on a single integrated circuit chip, or the LEDs may be implemented on one chip and the associated control circuitry implemented on another chip and stacked with the LED chip. In typical fabrication techniques, LEDs are first attached to a "submount" which is often a semiconductor device, usually with reverse bias protection diodes, or zener diodes to prevent device failure due to high transient currents or voltages. The circuitry shown in FIG. 4 can be fully integrated, and requires very little capacitance for operation; thus, the LEDs and associated circuitry may be completely integrated.

Figure 6:
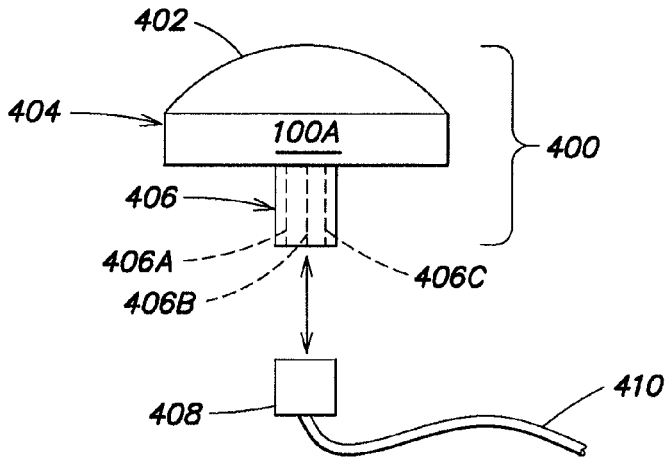
FIG. 6 illustrates an exemplary package for the lighting apparatus of FIG. 4, according to one embodiment of the present invention.

An automotive lighting apparatus according to one embodiment of the present invention, based on the circuit of FIG. 4, may further include a package for one or more integrated circuit chips in which the circuit is implemented. FIG. 6 very generally illustrates an exemplary package 400 for such a lighting apparatus, wherein the package includes one or more integrated circuit chips 404 in which the apparatus 100A is implemented, one or more optical elements 402 (e.g., a lens) to protect the chip(s) and allow for light output, and at least one electrical connector 406. In one aspect, the electrical connector 406 is configured to mate with a complimentary electrical connector 408 coupled to a wire harness 410 of an automobile. In another aspect, the electrical connector 406 (as well as the electrical connector 408) may include a first lead 406A electrically connected to the first node 108A to which the operating voltage is applied, and a second lead 406B electrically connected to the second node 108B to which the operating voltage is applied. A wide variety of electrical connectors suitable for automotive applications are known in the relevant arts and are contemplated for various implementations of the lighting apparatus shown in FIG. 6.

Accordingly, in one exemplary implementation, a complete package for an automotive lighting apparatus may include four series-connected LEDs and associated control circuitry on one or more integrated circuit chips, grouped under a lens in a two-lead package, and having an overall operating power on the order of 0.5 to 5 Watts.

In yet other aspects, the package 400 shown in FIG. 6 may include other components, typical examples of which include, but are not limited to, one or more resistors for setting the current or current/voltage characteristics, small capacitors for further EMI reduction, and possibly other filtering or protection components including inductors, capacitors, zener diodes, etc. The package 400 also may be provided with extra leads or a lead-frame with other features, such as mounting holes similar to those used on power transistors (e.g., the TO-220 or TO-247 package), or retaining clip landing areas. The additional leads may be used for various purposes, including mode or current setting, communications (if such features are added to the control circuit), calibration, or fault detection and sensing.

More specifically, since the control circuitry associated with the LEDs in the apparatus of FIG. 4 may be fabricated as a substrate for the LEDs, and such substrates may have a minimum size which may be greater than the size necessary to implement the control circuitry itself, other functions may also be included. Thus, in another embodiment, the controller 105A may implement a variety of functions beyond control of the controllable current paths and/or current source. In this manner, significant functionality may be included in such lighting devices with a relatively small increase in cost over the production cost of a typical packaged LED.

For example, as discussed above in connection with FIGS. 3 and 4, the controller 105A may include one or more communication ports (e.g., 120A and 120B shown in FIG. 4) for receiving and/or transmitting information. With reference again to FIG. 6, the electrical connector 406 of the package 400 may include a third lead 406C electrically connected to the communication port(s), such that the controller may receive first information via the third lead and at least one of the communication ports. Likewise, in one embodiment the controller may include a memory to store second information, and may transmit at least some of the second information from at least one communication port via the third lead to the wire harness 410 of the automobile.

There are numerous exemplary situations in which the ability to communicate information (e.g., data representing lighting instructions or external conditions relating to some aspect of the automobile) to and from the controller of the lighting apparatus would be extremely powerful, even in the case where the controller performs some function based on the information that may have little or nothing to do with generating light from the series-connected LED stack. For example, the controller may include memory that includes various type of logging information (e.g., related to device testing), and/or a unique serial number, accessible through one of the communication ports 120A and 120B, to allow tracking of automobile parts in which the apparatus is installed. Information communicated to the controller may relate to operation of the lighting apparatus itself, for example, sensing an external condition, such as temperature, opening or closing of a door, panel, valve, or operation of a user interface or other switch, or analog sensor. Information transmitted by the controller may also be used to effect external operations, such as control of indicators, motors, solenoids, valves, pumps, locking devices, fans or other light sources in the automobile. Additionally, the controller memory may be used to store information about how the controller should respond to external signals. Such functionality could be implemented as a fully generalized stored computer program.

In view of the foregoing, numerous varieties of automotive lighting apparatus according to the present invention with various functionalities are contemplated. For example, a given lighting apparatus could both produce light for a door handle, as well as providing control of a door lock mechanism. The same device with different programming could be a dome light, with support for capacitive touch switches to control its operation. One device could operate both backup and brake light functions.

In yet other embodiments, multiple lighting apparatus according to FIG. 3 or 4 may be employed in parallel or series configurations. In particular, for operating voltages significantly higher than 12 to 15 volts, one or more conventional LEDs or conventional LED packages (i.e., without the control functionality of the apparatus of FIG. 4) may be used in series with an apparatus of FIG. 4, wherein the control functionality of the apparatus of FIG. 4 is employed to accommodate decreases in the operating voltage applied to the multiple serially-connected devices. In this manner, the apparatus of FIG. 4 serves as an "intelligent" or "active" element in a series connection of such devices, while the one or more conventional LEDs or conventional LED packages are "dumb" or "passive" elements in the series connection. In one aspect, such a configuration of elements may be particularly well-suited for 24 Volt systems.

In other aspects, lighting apparatus according to the present invention similar to those shown in FIGS. 3 and 4 have an appreciably low capacitance to allow for compatibility with so-called "low voltage electronic transformers," which include a bridge rectifier for providing a DC voltage derived from an AC line voltage. In particular, the resistive nature of the lighting apparatus shown in FIG. 4 makes the apparatus particularly well-suited for applications requiring relatively high power factor. Specifically, the current source 310 in the circuit of FIG. 4 is configured to set the series current $I_{series}$ based on the operating voltage applied to the nodes 108A and 108B, via the voltage divider former by resistors R43 and R42; in this manner, the resistor R43 performs a "voltage sensing" function and the current drawn by the apparatus tracks changes in the operating voltage. By configuring an LED-based lighting apparatus to appear as an essentially resistive or linear load, transformer saturation, acoustic noise, and input harmonic currents may be reduced, and power factor thereby improved.

In yet other embodiments of the invention according to the present disclosure, rather than control series-connected LEDs based on changes in operating voltage, a lighting apparatus similar to that shown in FIG. 3 may be configured such that the controller 105A controls each of the LEDs 104A and 104B as individually and independently controllable channels of a multi-channel lighting unit pursuant to one or more lighting instructions or lighting commands received via the communication port 120A, as discussed above in connection with FIGS. 1 and 2. Again, a given lighting apparatus based on the general circuit architecture shown in FIG. 3 may have two or more independently controllable channels; for example, in one embodiment, a lighting apparatus may comprise only white LEDs, and include a "warm white channel" having one or more warm white LEDs located at a first height in the stack, and a "cool white channel" having one or more cool white LEDs located at a second height in the stack. Alternatively, a lighting apparatus may include a "red" channel including one or more red LEDs located at a first height in the stack, a "green" channel including one or more green LEDs located at a second height in the stack, and a "blue" channel including one or more blue LEDs located at a third height in the stack. Of course, various combinations of colored and white LEDs may be employed in different implementations.

Figure 7:
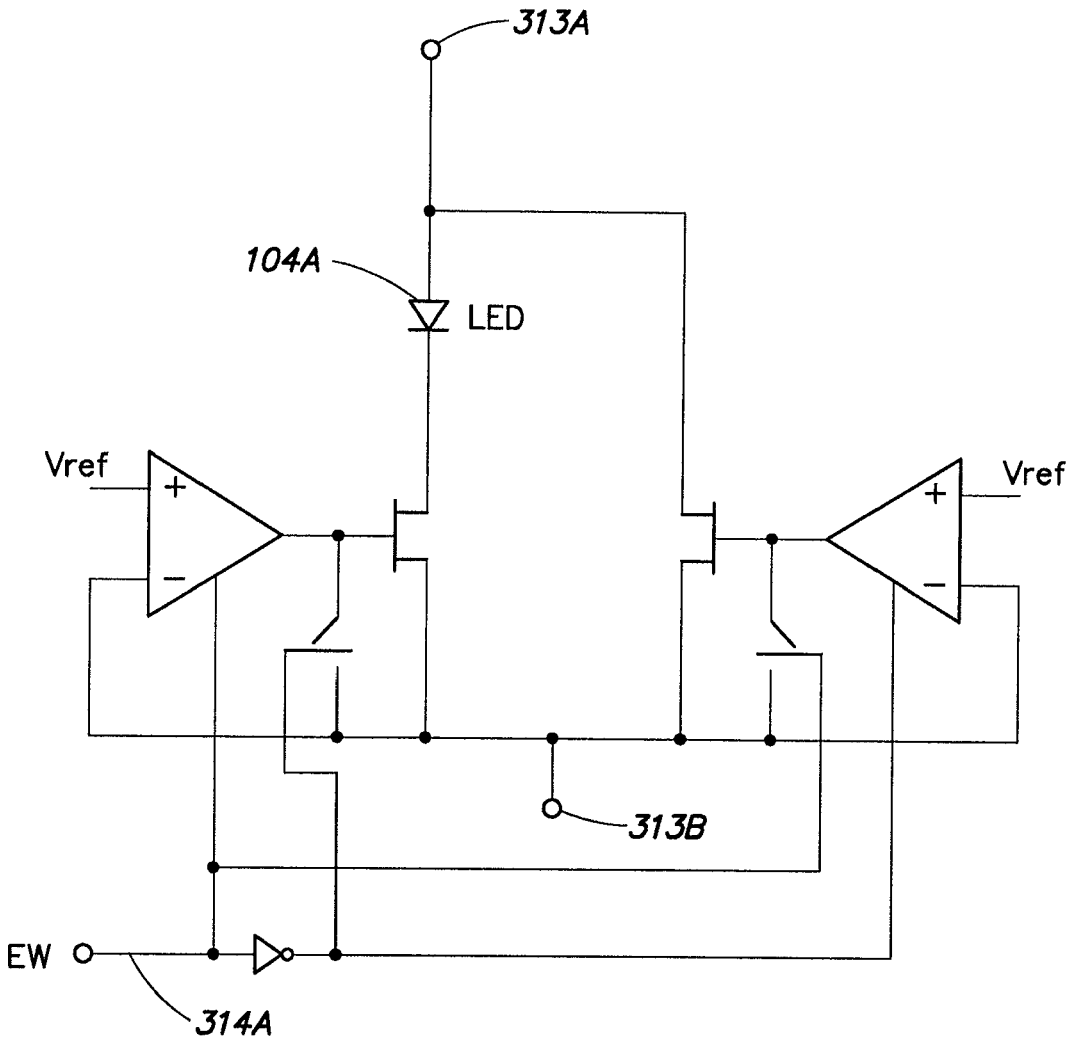
FIG. 7 illustrates an exemplary circuit for controlling node voltage across a given LED in a series-connected LED stack, according to one embodiment of the present invention.

In many applications, node voltage fluctuations based on LEDs being switched into or out of the series-connected stack may have little or no consequence. However, in some circumstances, voltage balancing devices may optionally be used to maintain a spread of power dissipation and avoid voltage excursions at nodes at different heights in the LED stack, as this may reduce power which otherwise may be wasted driving various capacitances (in some cases including the capacitance of an LED itself). One implementation of a circuit, including both voltage balancing and current diverting sections for a given LED in as series-connected stack, is shown in FIG. 7 and employs two operational amplifiers to control the two sides of a differential transistor pair. The voltage references to these amplifiers may be changed, or they may be switched off, to decrease output voltage so as to turn on/off the appropriate current path. In various aspects, the voltage references may be fixed as percentages of the operating voltage, may contain both ratiometric and fixed voltage components or may be partially or fully programmable (e.g., under the control of the controller 105A).

Figure 8:
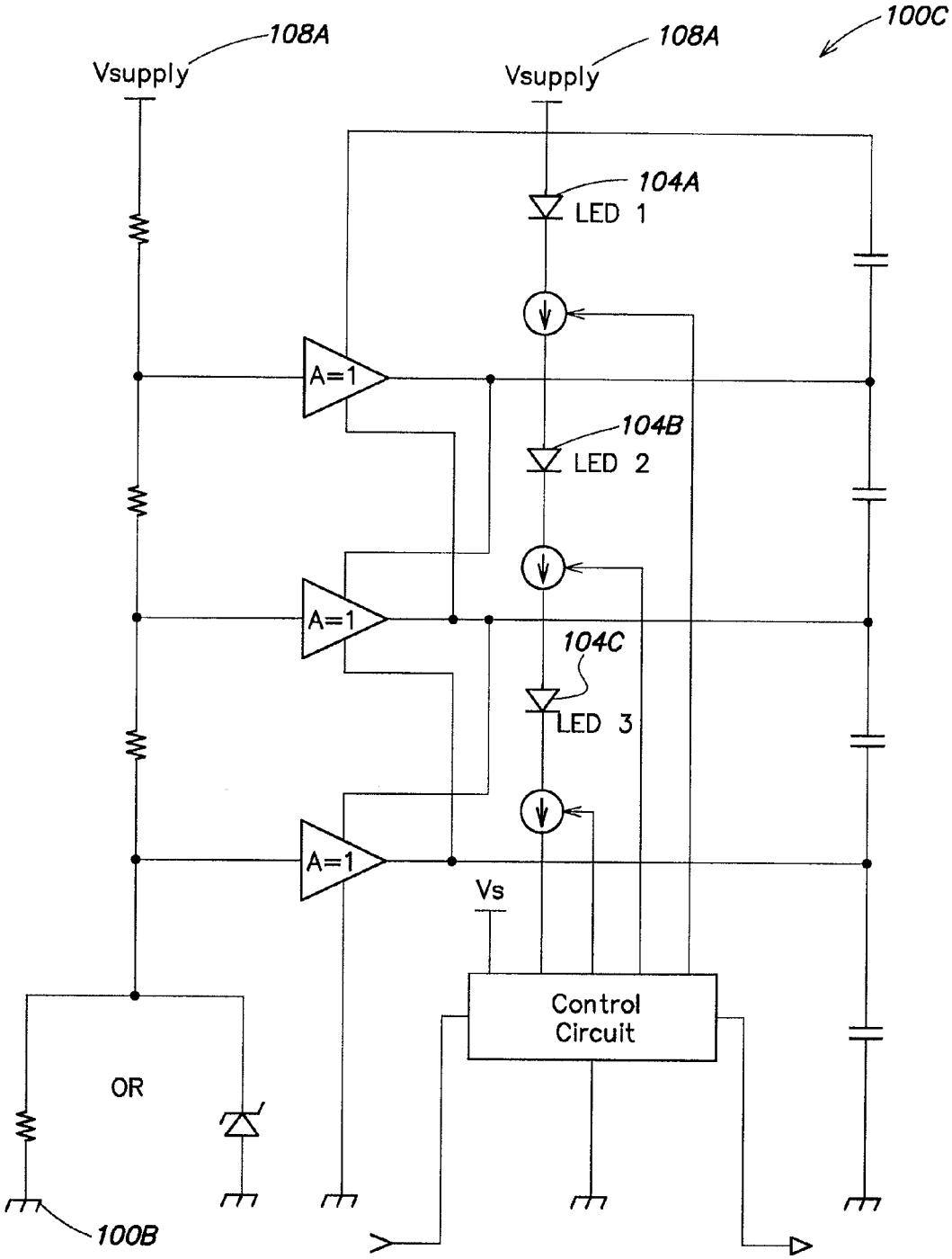
FIG. 8 illustrates a lighting apparatus according to another embodiment of the present invention employing operational amplifier power supplies to generate respective node voltages in a series-connected LED stack, and individual current sources for each LED.

In another embodiment of a lighting apparatus according to the present disclosure, multiple different node voltages are generated with operational amplifiers, and controllable current sources driving LEDs between each of the node voltages are utilized. These circuits are typically more complex, and utilize more devices which must be sized to handle the full current, and hence are less cost effective. Additionally, they may require external capacitors to maintain stability. A 3-LED example of one such lighting apparatus 100C is shown in FIG. 8.

Figure 9:
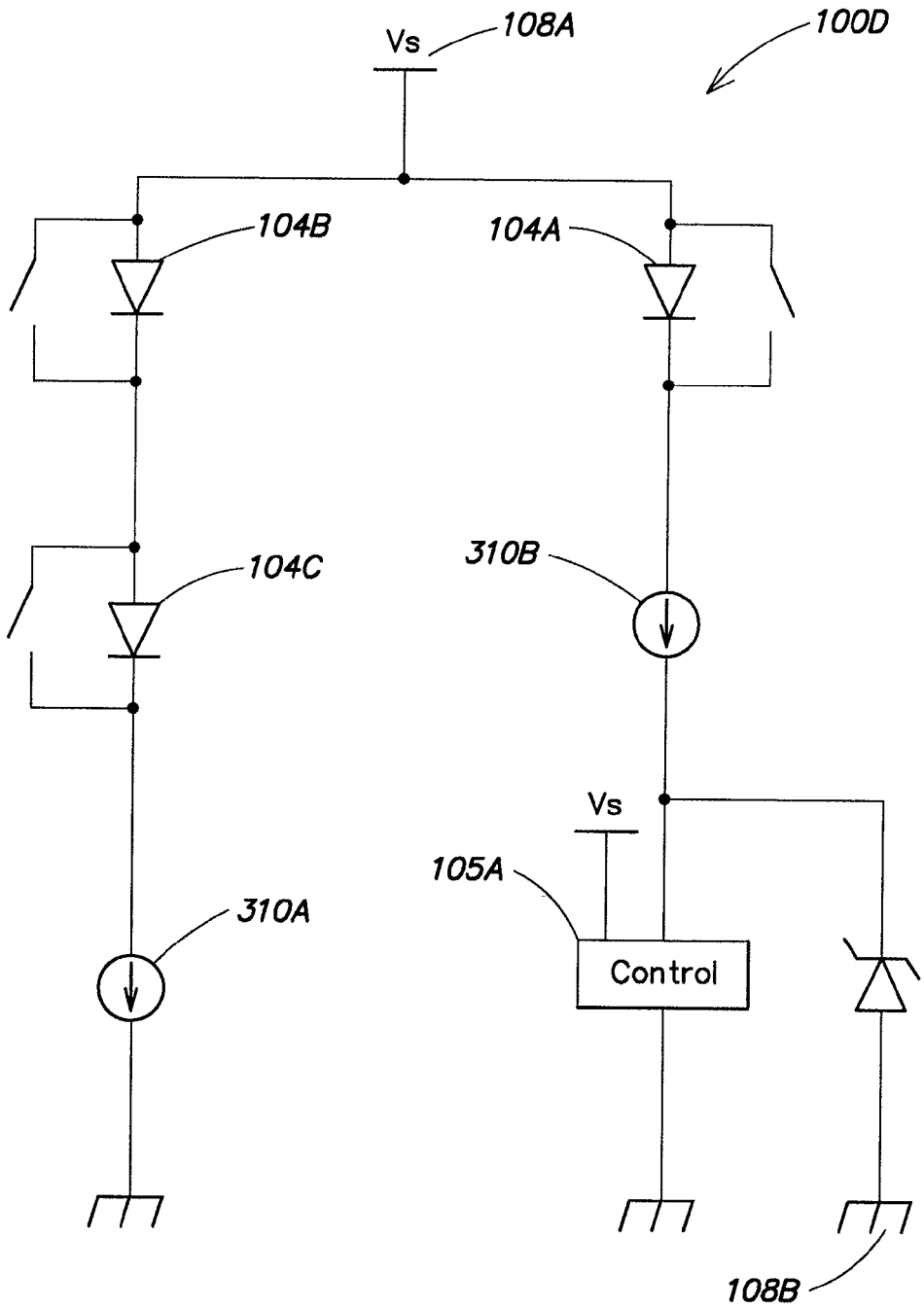
FIG. 9 illustrates a lighting apparatus according to another embodiment of the present invention having different groupings of controllable channels associated with corresponding current sources.

In other aspects of multi-channel lighting apparatus employing series-connected LEDs, it should be appreciated that the series-connected circuit arrangements are generally less efficient than multiple controllable LED channels connected in parallel across an operating voltage, in that current still flows through the entire circuit, rather than being shut off in a given channel, when one or more channels are not energized. To mitigate this effect and conserve power, in some embodiments the series current flowing in the stack of devices may be reduced, either linearly, or following the activation signals of the LEDs. In one aspect, it may be generally advantageous to align the activation signals of the LEDs so that the large LED current flows through all of the devices at the same time, and a clear period exists, during which the current source that sets the series current may be shut off. In other embodiments of lighting apparatus according to the present disclosure, controllable LED channels may be separated into groups, each group having a separate current source, as shown by the apparatus 100D illustrated in FIG. 9.

Figure 10:
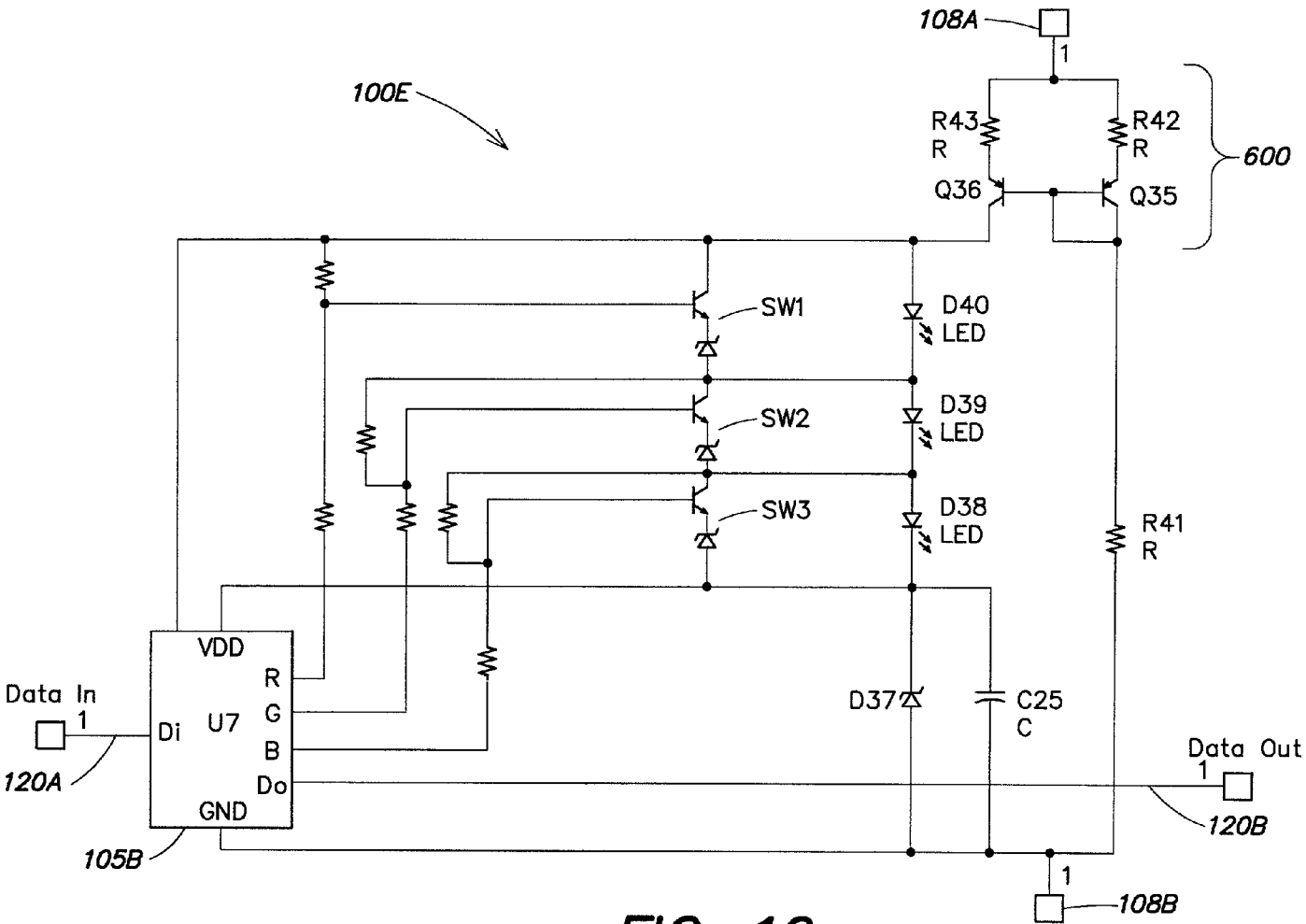
FIG. 10 illustrates a lighting apparatus according to another embodiment of the present invention that is particularly configured to simulate a resistive load.

FIG. 10 illustrates an LED-based lighting unit 100E according to yet another embodiment of the present invention that is based generally upon the architecture of series-connected LEDs and current diversion around respective LEDs. The apparatus of FIG. 10 is additionally configured to behave essentially as a resistive or linear element, based upon concepts disclosed in U.S. Provisional Application Ser. No. 60/883,620, which is incorporated herein by reference. In particular, the apparatus of FIG. 10 includes series-connected LEDs D38, D39 and D40 and corresponding switches SW1-SW3 (formed, for example, by a transistor in series with a zener diode) that function in part as shunt voltage regulators. The apparatus also includes a current mirror circuit 600 that causes the apparatus 100E to appear as an essentially resistive or substantially linear load to an operating voltage coupled to the nodes 108A and 108B. Depending on the voltage requirements of the controller 105B, the apparatus also may include a zener diode D37 to provide a supply voltage for the controller 105B (U7).

Figure 11:
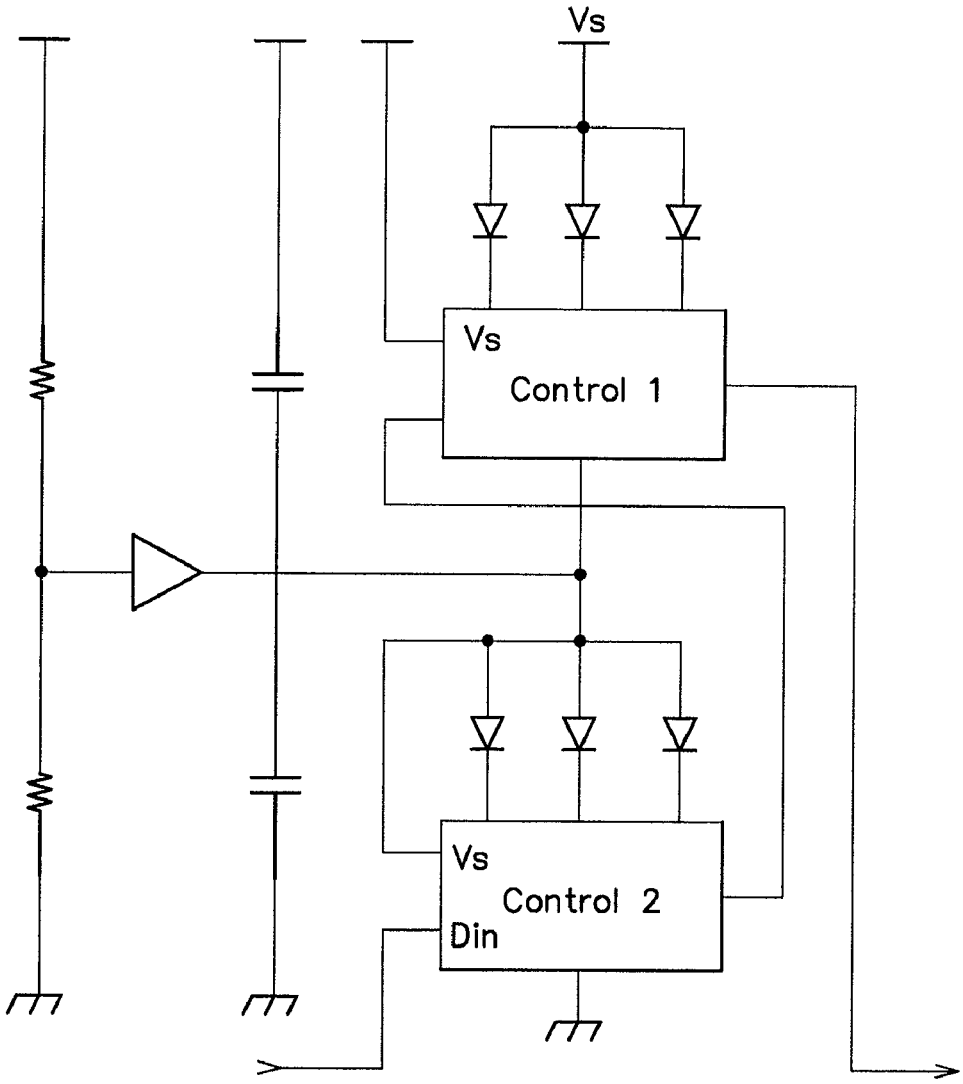
FIGS. 11 and 12 illustrate a "rail splitting" architecture to provide power to multiple lighting units from an operating voltage, according to one embodiment of the present invention.
Figure 12:
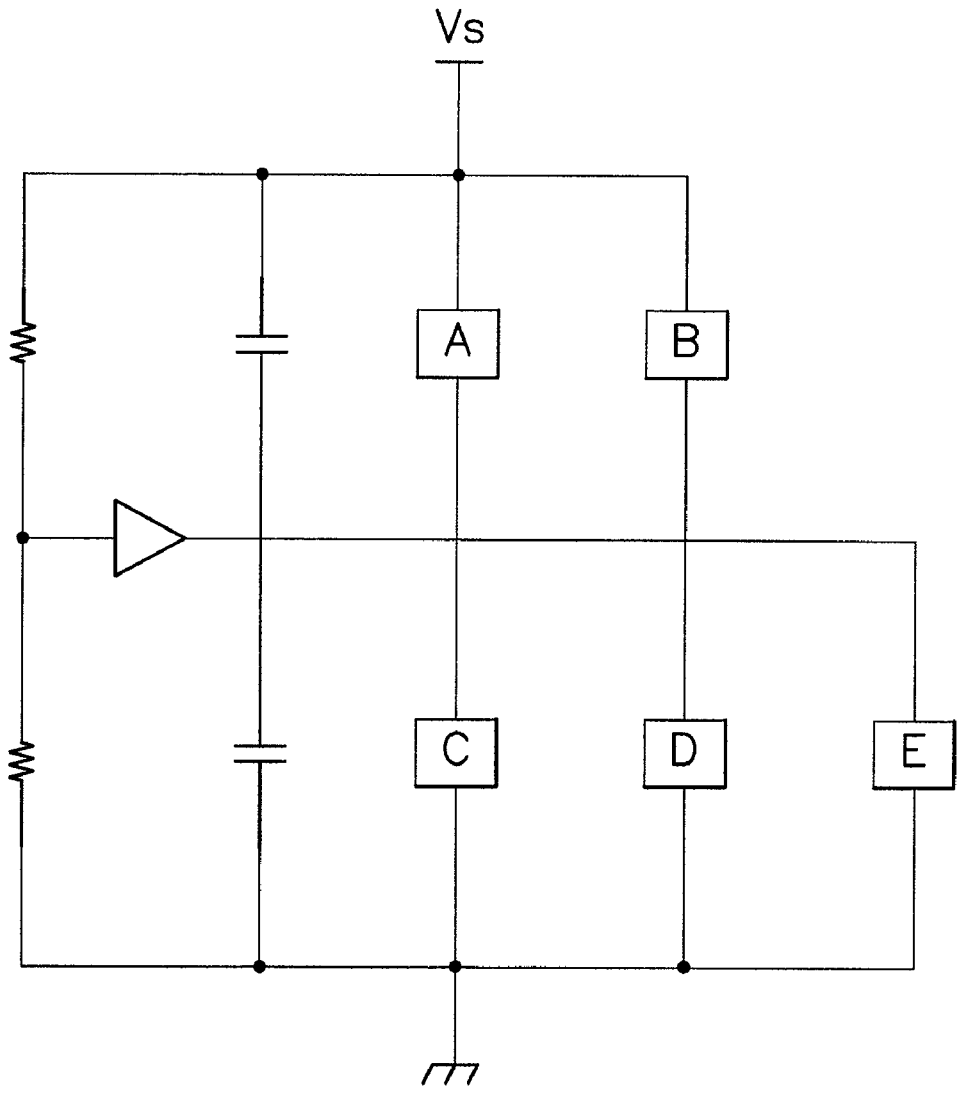

In yet another embodiment, the combination of LEDs and a controller to form a lighting unit as discussed above in connection with any one of above-described figures may be stacked two-high between an operating voltage, as shown in FIG. 11 and, as shown in FIG. 12, multiple such lighting units (labeled as "A" through "E") may share one amplifier in a "rail splitting" architecture to divide the operating voltage so as to provide power to all lighting units. The number of lighting units above and below the rail splitting amplifier need not be identical, and the lighting units themselves need not be similar (e.g., different LEDs may be used in different lighting units, and the data wiring need not maintain any relationship with the stack level). The amplifier may or may not be a dissipating device, for example, it could be a switch mode power supply, similar to many audio amplifier designs. Also, the amplifier may or may not be integrated with one of the control circuits. Further, the control circuits may have data inputs, which may be either capacitively coupled, or may use other schemes to communicate between themselves.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Various embodiments of the present invention are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B." or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An apparatus, comprising:

at least two LEDs connected in series between a first node and a second node, wherein a series current flows between the first node and the second node when an operating voltage is applied across the first node and the second node;

at least one controllable current path connected in parallel with at least a first LED of the at least two LEDs for at least partially diverting the series current around the first LED; and at least one controller for monitoring at least one parameter representative of the operating voltage and determining a maximum number of LEDs of the at least two LEDs that can be energized by the operating voltage, the at least one controller controlling the at least one controllable current path so as to increase an amount of the series current that is diverted around at least the first LED when the maximum number is less than a total number of all of the at least two LEDs connected in series.

2. The apparatus of claim 1, wherein the at least one controller controls the at least one controllable current path so as to increase the amount of the series current that is diverted around the first LED when the at least one parameter indicates that the operating voltage is less than a predetermined threshold value, and wherein the predetermined threshold value represents a minimum operating voltage necessary to energize all of the at least two LEDs.

3. The apparatus of claim 1, wherein the at least one controller controls the at least one controllable current path to substantially divert the series current around the first LED so as to short circuit the first LED.

4. The apparatus of claim 1, wherein:

the at least two LEDs include at least three LEDs connected in series between the first node and the second node; and the at least one controllable current path includes a plurality of controllable current paths responsive to the at least one controller, each current path connected in parallel with at least one of the at least three LEDs.

5. The apparatus of claim 4, wherein the at least three LEDs includes a first number of LEDs, wherein the plurality of controllable current paths includes a second number of controllable current paths, and wherein the first number and the second number are different.

6. The apparatus of claim 4, wherein the at least three LEDs includes a first number of LEDs, wherein the plurality of controllable current paths includes a second number of controllable current paths, wherein the first number and the second number are the same, and wherein each current path is connected in parallel with a corresponding one of the at least three LEDs.

7. The apparatus of claim 4, wherein the at least one controller controls at least some of the plurality of controllable current paths, and wherein each controllable current path controlled by the controller intermittently diverts the series current around the corresponding at least one of the at least three LEDs, such that less than all of the at least three LEDs are simultaneously energized.

8. The apparatus of claim 7, wherein the at least one controller sequentially controls the at least some of the plurality of controllable current paths.

9. The apparatus of claim 7, wherein the at least one controller simultaneously controls at least two of the at least some of the plurality of controllable current paths.

10. The apparatus of claim 1, further comprising a current source, connected in series with the at least two LEDs between the first node and the second node, for setting the series current.

11. The apparatus of claim 10, wherein the current source is configured to set the series current based on the operating voltage.

12. The apparatus of claim 10, wherein the current source is responsive to the at least one controller, and wherein the at least one controller controls the series current based at least in part on the monitored at least one parameter representative of the operating voltage.

13. The apparatus of claim 12, wherein the at least one controller is configured to control the current source so as to increase the series current as the operating voltage decreases.

14. The apparatus of claim 12, wherein the at least one controller is configured to control the current source so as to duty cycle modulate the series current based at least in part on the monitored at least one parameter representative of the operating voltage.

15. A method of energizing a plurality of LEDs connected in series between a first node and a second node, wherein a series current flows between the first node and the second node when an operating voltage is applied across the first node and the second node, the method comprising:

A) monitoring at least one parameter representative of the operating voltage;

B) determining a maximum number of LEDs of the at least two LEDs that can be energized by the operating voltage; and C) when the maximum number is less than a total number of all of the at least two LEDs connected in series, shorting out at least one of the plurality of LEDs so that less than all of the plurality of LEDs are simultaneously energized.

16. The method of claim 15, wherein C) comprises successively energizing different ones of the plurality of LEDs, or different groupings of less than all of the plurality of LEDs.

17. An apparatus, comprising:

a plurality of LEDs connected in series between a first node and a second node, wherein a series current flows between the first node and the second node when an operating voltage is applied across the first node and the second node;

a plurality of controllable current paths, each current path connected in parallel with a corresponding one of the plurality of LEDs for diverting the series current around the corresponding one of the plurality of LEDs;

a current source connected in series with the plurality of LEDs between the first node and the second node for setting the series current; and at least one controller for monitoring at least one parameter related to the operating voltage and for intermittently controlling the plurality of controllable current paths so as to divert the series current around respective corresponding ones of the plurality of LEDs in a timed sequence when the at least one monitored parameter indicates that the operating voltage is less than a predetermined threshold value, such that less than all of the plurality of LEDs are simultaneously energized.

18. The apparatus of claim 17, wherein the at least one controller is configured to control the current source to increase the series current so as to maintain an essentially constant brightness of light generated by the plurality of LEDs when the operating voltage falls below the predetermined threshold value.

19. The apparatus of claim 17, wherein:

the plurality of LEDs includes at least one first LED for generating first radiation having a first spectrum, and at least one second LED for generating second radiation having a second spectrum different than the first spectrum; and the at least one controller controls the plurality of controllable current paths in a predetermined manner based at least in part on the different spectrums of the plurality of LEDs.

20. The apparatus of claim 19, wherein:

the at least one first LED includes at least one first white LED, such that the first spectrum corresponds to a first color temperature;

the at least one second LED includes at least one second white LED, such that the second spectrum corresponds to a second color temperature different than the first color temperature; and the at least one controller controls the plurality of controllable current paths such that an overall color temperature of the light generated by the plurality of LEDs, based on at least one of the first spectrum and the second spectrum, decreases as the operating voltage falls below the predetermined threshold value.

21. An automotive lighting apparatus, comprising:

at least one integrated circuit chip, comprising:

a first number of LEDs connected in series between a first node and a second node, wherein a series current flows between the first node and the second node when an operating voltage is applied across the first node and the second node;

a second number of controllable current paths, wherein the second number is equal to or less than the first number, each current path connected in parallel with a corresponding one of the first number LEDs for diverting the series current around the corresponding one of the first number of LEDs;

a current source connected in series with the first number of LEDs between the first node and the second node for setting the series current; and at least one controller for monitoring at least one parameter representative of the operating voltage and determining a maximum number of LEDs of the first number of LEDs that can be energized by the operating voltage, the at least one controller controlling the second number of controllable current paths so as to divert the series current around respective corresponding ones of the first number of LEDs when the maximum number is less than the first number, such that less than all of the first number of LEDs are simultaneously energized; and a package for the at least one integrated circuit chip, the package including at least one first electrical connector configured to mate with a complimentary electrical connector or wire harness of an automobile, the at least one first electrical connector including at least a first lead electrically connected to the first node and a second lead electrically connected to the second node for applying the operating voltage across the first node and the second node.

22. The apparatus of claim 21, wherein the first number is four.

23. The apparatus of claim 21, wherein the at least one controller includes at least one communication port for receiving and/or transmitting information, and wherein the at least one first electrical connector includes at least a third lead electrically connected to the at least one communication port.

24. The apparatus of claim 23, wherein the at least one controller controls the second number of controllable current paths based at least in part on first information received by the at least one communication port via the third lead, and wherein the first information relates to an external condition associated with the automobile.

25. The apparatus of claim 23, wherein the at least one controller includes at least one memory to store second information, and wherein the at least one controller transmits at least some of the second information from the at least one communication port via the third lead.

* * * * *